US005715656A

United States Patent [19]

Pearce

[11] Patent Number: 5,715,656

[45] Date of Patent: Feb. 10, 1998

[54] FORM, FILL AND SEAL MACHINE

[75] Inventor: Larry N. Pearce, Oak Park, Ill.

[73] Assignee: Triangle Package Machinery Corporation, Chicago, Ill.

[21] Appl. No.: 596,727

[22] Filed: Feb. 5, 1996

[51] Int. Cl.[6] ..... B65B 9/20; B65B 59/00; B65B 9/22; B65B 41/12

[52] U.S. Cl. ..... 53/451; 53/201; 53/389.2; 53/389.5; 53/551; 493/302

[58] Field of Search ..... 53/551, 552, 201, 53/389.2, 389.4, 389.5, 451; 493/478, 479, 471, 468, 302

[56] References Cited

U.S. PATENT DOCUMENTS

| | | | |
|---|---|---|---|
| 2,751,732 | 6/1956 | Woppman . | |
| 3,054,236 | 9/1962 | Stroop | 53/201 X |
| 3,140,030 | 7/1964 | Stewart | 226/95 |
| 3,159,955 | 12/1964 | Thurlings . | |
| 3,262,349 | 7/1966 | Hollenton et al. | 83/209 |
| 3,266,216 | 8/1966 | Van Den Bos | 53/551 |
| 3,287,199 | 11/1966 | Virta | 156/583 |
| 3,486,424 | 12/1969 | Tanner | 53/551 X |
| 4,136,505 | 1/1979 | Putnam, Jr. et al. | 53/551 |
| 4,391,081 | 7/1983 | Kovacs | 53/436 |
| 4,501,109 | 2/1985 | Monsees | 53/451 |
| 4,506,494 | 3/1985 | Shimoyama et al. | 53/551 |
| 4,512,138 | 4/1985 | Greenawalt | 53/451 |
| 4,532,753 | 8/1985 | Kovacs | 53/451 |
| 4,563,862 | 1/1986 | McElvy | 53/552 |
| 4,578,931 | 4/1986 | Roovers | 53/551 |
| 4,620,409 | 11/1986 | McElvy | 53/551 |
| 4,630,429 | 12/1986 | Christine | 53/479 |
| 4,719,741 | 1/1988 | Mabry | 53/451 |
| 4,750,313 | 6/1988 | Kammier et al. | 53/451 |
| 4,910,943 | 3/1990 | Taylor et al. | 53/551 |
| 4,947,621 | 8/1990 | Christine et al. | 53/451 |
| 4,999,974 | 3/1991 | Kovacs et al. | 53/434 |
| 5,274,984 | 1/1994 | Fukuda | 53/389.2 |
| 5,347,795 | 9/1994 | Fukuda | 53/552 |
| 5,388,387 | 2/1995 | McElvy | 53/551 X |
| 5,524,413 | 6/1996 | Fukuda | 53/389.2 X |
| 5,537,798 | 7/1996 | Fukuda et al. | 53/201 X |
| 5,576,588 | 11/1996 | Umeda et al. | 53/551 X |

FOREIGN PATENT DOCUMENTS 1334616 10/1973 United Kingdom .

*Primary Examiner*—Horace M. Culver
*Attorney, Agent, or Firm*—Brinks Hofer Gilson & Lione

[57] ABSTRACT

A form-fill-seal machine in which any of a selection of change parts assemblies can be slid into and out of mounting slots and secured in proper alignment by a hand operated toggle lock mechanism. A pair of stops are provide on the forming shoulder of the change part that correspond to the diameter of the forming tube. An articulated floating vacuum pull belt arrangement, having stops that engage the stops on the forming shoulder, automatically aligns itself with the change parts assembly. The film cage is adjustable for film tracking and can be tilted to a position that permits the film roll to be loaded without the need of a power hoist. The film tracking and film cage tilting are on a common axis, which simplifies the design and reduces the parts. The tiltable film cage has the added advantage of improving the access to the inside area of the machine when the film cage is tilted to the load position. This feature of the invention also reduces the overall size of the machine.

47 Claims, 13 Drawing Sheets

FIG. 1
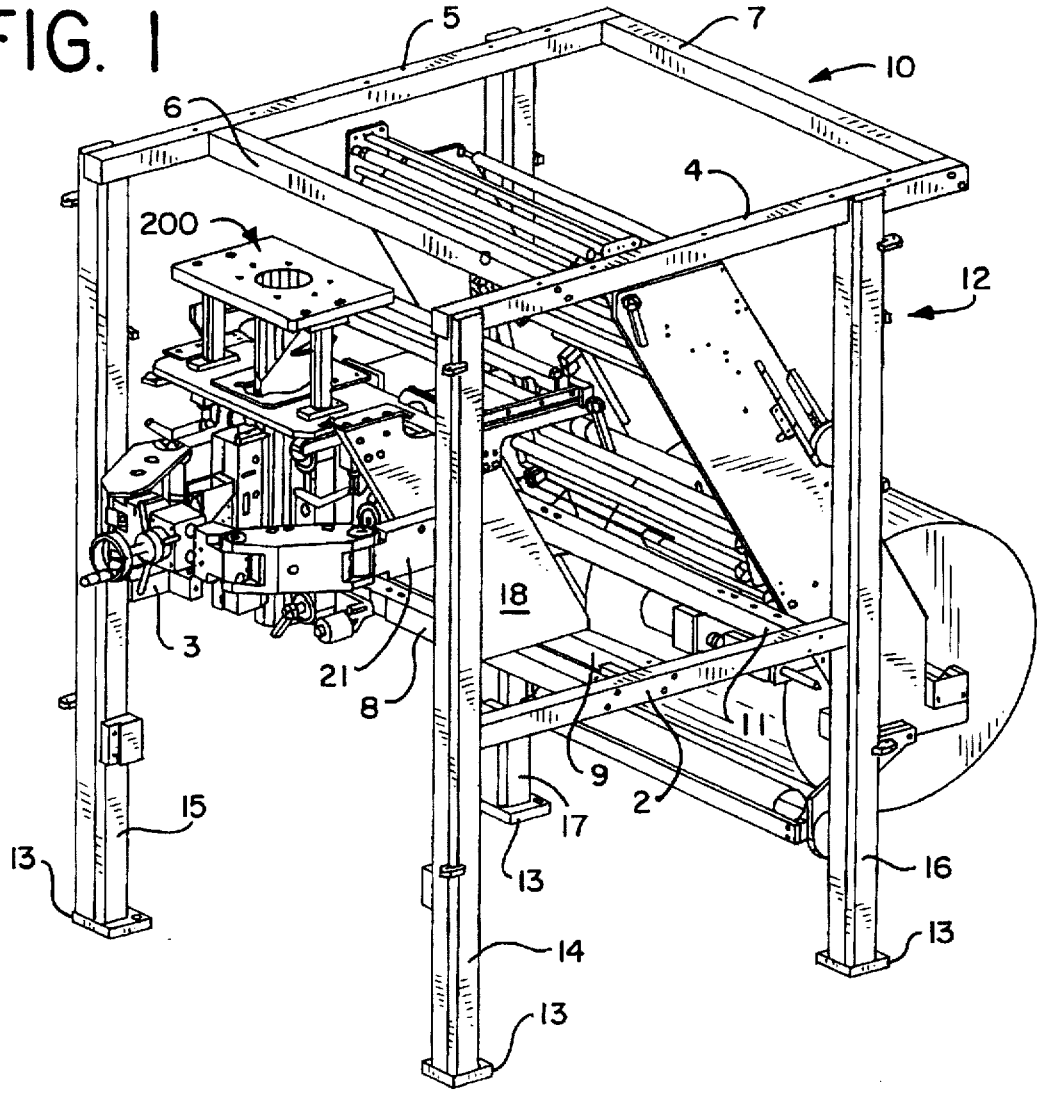
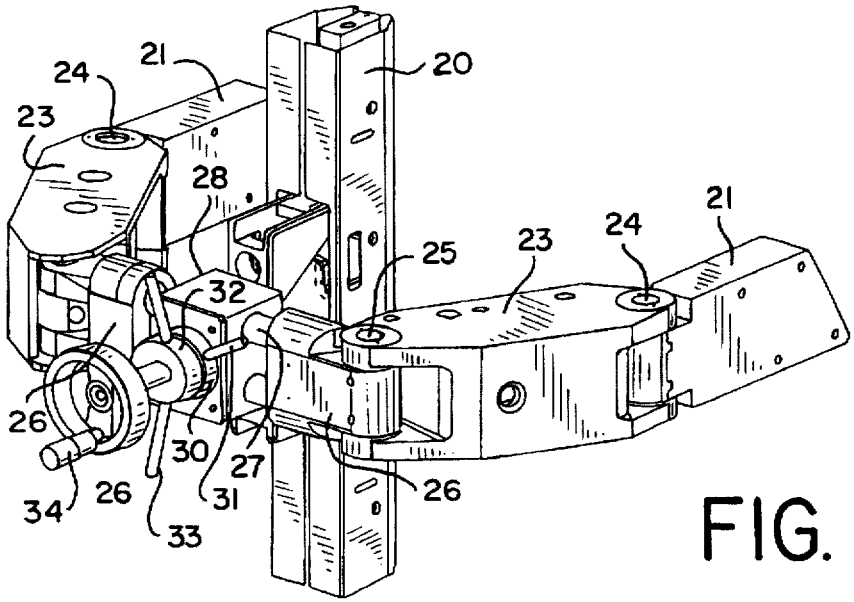
FIG. 2

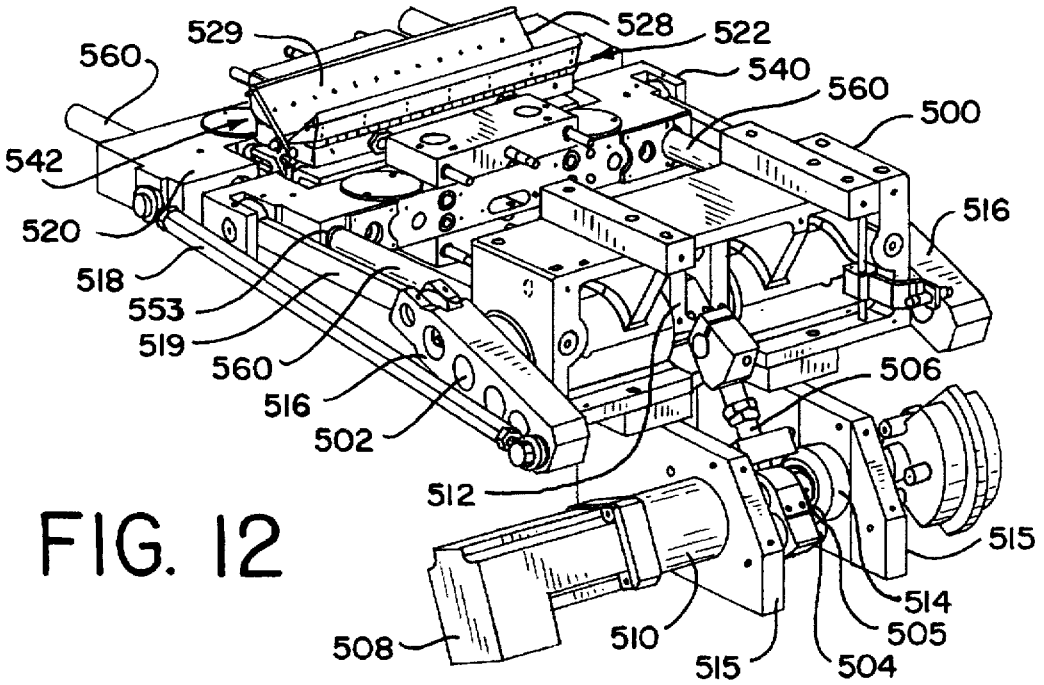
FIG. 12
FIG. 13
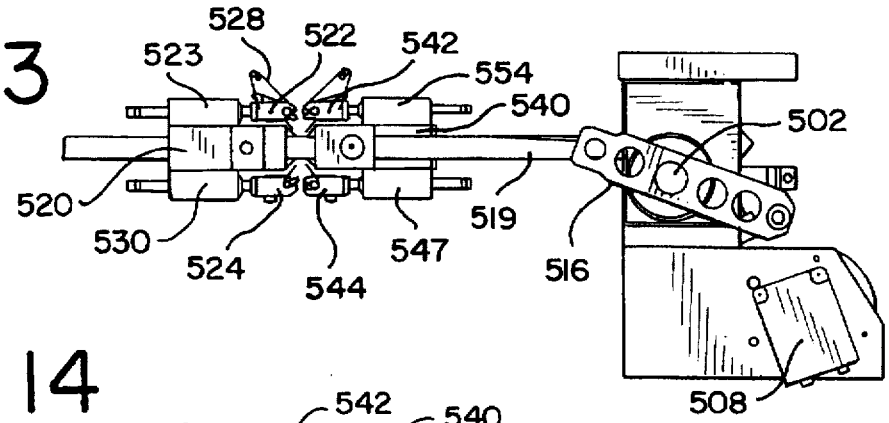
FIG. 14
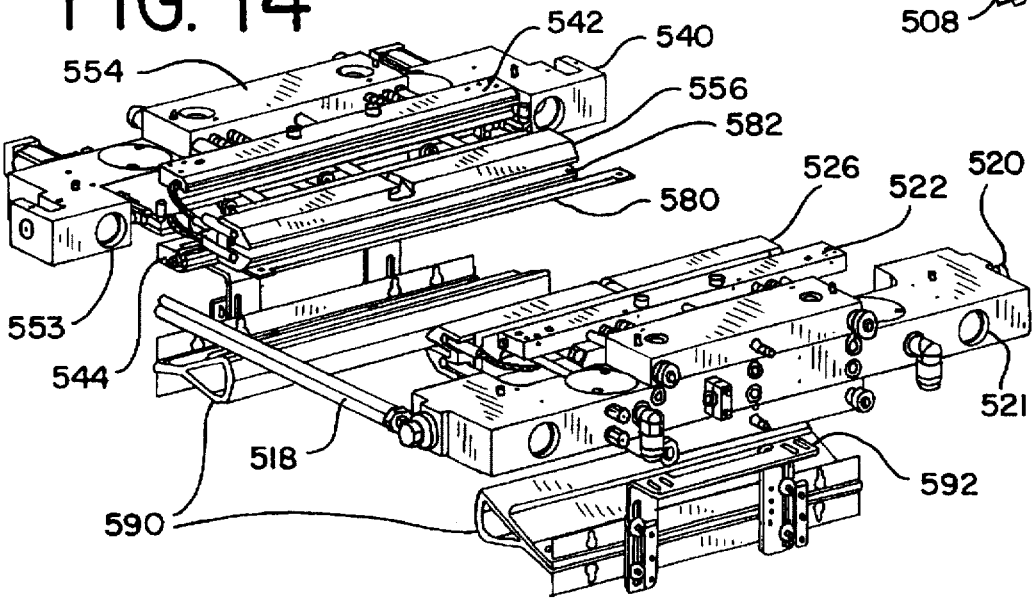

FORM, FILL AND SEAL MACHINE

BACKGROUND OF THE INVENTION

This invention relates to a form-fill-seal packaging machine and more particularly to vertical form-fill-seal packaging machine. In a machine of this type, a web of flexible packaging material is guided from the supply roll to a forming shoulder which forms the flexible packaging material into a tube shape. The flexible packaging material flows from the forming shoulder to the forming tube. The product to be packaged is fed into the open upper end of the forming tube and then out its bottom into the tubular shaped package that is being formed. The tubular shaped material is intermittently fed downward and the longitudinal edges of the flexible packaging material are sealed to form a longitudinal tube seam. The tubular shaped package is sealed at package length intervals and cut into individual packages. The prior art form-fill-seal machines include vacuum belts, that are rigidly mounted relative to the forming tube, to pull the film downward along the forming tube.

A basic form-fill-seal machine can be adapted to form packages of different shapes and sizes. In the prior art machines, the forming shoulder, forming tube and the spout through which the product is fed are replaced when a package of a different size is to be run on the machine. The current forming shoulder and forming tube must be released and removed and the new set of forming mechanisms must be properly located and secured in place. In the prior art vacuum belt machines, the vacuum belts that pull the film downward along the forming tube must be precisely located and accurately aligned with the new forming tube. Proper alignment is critical for acceptable operation of the machine and requires considerable time and effort by a highly skilled technician. In current machines, when a new set of forming mechanisms are mounted to accommodate a package of a different size, a skilled mechanic is required to insure proper adjustment and alignment of the belts that pull the film downward. This is a tedious and time consuming task.

The cross seal mechanism, that seals the top and bottom of each package produced on form-fill-seal packaging systems, is a critical component of such a system insofar as controlling the quality of the package. It is also the component that is most vulnerable to failure. The cross seal mechanism must operate at a precise time in the package cycle and must complete its operation with precision and speed. The temperatures of the clamping jaws and cooling jets must be controlled with precision in order to produce high quality seals. Current seal mechanism are complex and require constant monitoring and adjustment to assure the quality of the finished product.

Form-fill-seal machines utilize large heavy film rolls that must be replaced and threaded when a film roll is exhausted or a different type or size of film is required. Operation of the machine must be stopped when a film roll is being changed and, thus, production from the machine ceases during this operation. Current form-fill-seal machines require a hoist to lift and place the new film roll in its proper location on the machine. Current machines also require a skilled operator both to thread the film through a maize of rollers, that control and feed the film, and to splice the film to the end of the previous film. This procedure is time consuming and, thus, results in expensive downtime for a form-fill-seal machine.

Form-fill-seal machines are used primarily in the food industry where cleanliness and freedom from contamination is essential. As a result, the regular maintenance of such machines includes a carefully scrutinized cleaning of all actuating components. In current form-fill-seal machines some actuating components are not enclosed and thus are difficult to maintain clean, thus rendering the machine vulnerable to contamination.

For the foregoing reasons, there is a need for a form-fill-seal machine in which the parts that must be replaced when adapting the machine for a different shape or size package can be easily and quickly removed and replaced by a machine operator who has no particular training or skills in this aspect of the machine.

There is also a need for a machine in which the film advancing mechanism can be easily and quickly adjusted to a new size or shaped package and can advance the film without placing the film under unacceptable stress.

Furthermore, there is a need for a form-fill-seal machine in which the cross seal system has a simple design, including cartridge heaters and precise servo motor drives, that provides reliable performance and high quality seals.

There is also a need for a form-fill-seal machine that has a simplified film cage that pivots about an axis between operating and loading positions and shifts laterally about this same axis for the purpose of tracking the film.

There is a need for a film cage that can pivot to a loading position at which the film roll can be loaded without the use of a hoist or other power equipment.

Still further, there is a need for a form-fill-seal machine that includes a film advance mechanism that automatically positions spaces the belts from the forming tube and provides stress free film advance.

In addition, there is a need for a form-fill-seal machine in which the actuating components are enclosed to avoid contamination and to simplify cleaning of the machine.

SUMMARY OF THE INVENTION

The present invention provides a new form-fill-seal machine that includes various new and unique features, each of which represents an advance over the prior art.

This invention includes a new and novel change parts assembly that includes the forming shoulder and forming tube that can be slid into and out of mounting slots and secured in proper alignment by a hand operated toggle lock mechanism.

This invention also possesses an articulated floating vacuum pull belt arrangement that automatically aligns itself with the change parts assembly and provides stress free film advance.

This invention further contains a new and improved cross sealing jaw in which the single piece sealing jaw mechanisms are fixed relative to the slide brackets, and the grippers can move independently thereof. The operation of the new and improved sealing jaw comprises a process in which after the sealing jaws are partially opened the machine pauses, air is blown on the seal during this pause and then the jaws are fully opened while the air continues to blow on the seam. This feature provides an advantage over the prior art since it produces a superior seal and can better accommodate multiple layers of material, including zipper film material.

The present invention has a film feed cage that is adjustable for film tracking and that can be tilted to a position that permits the film roll to be loaded without the need of a power hoist. The film tracking and cage tilting are on a common axis, which simplifies the design and reduces the parts. The film cage can be tilted into the operative position after the film roll has been loaded.

This invention further includes a film feed cage that has fewer rollers than the prior art machines and includes dancer rolls that can be raised to a position during the loading operation at which there is an open straight film loading path.

The tiltable film feed of the present invention has the added advantage of improving the access to the inside area of the bagging machine when the film roll holder is tilted to the load position. This feature of the invention also reduces the overall size of the machine.

The present invention also consists of a dancer roll assembly that can be raised to a position relative to idler rolls, which opens up a straight line passage for the film to be threaded and greatly facilitates loading of the film.

While a number of control systems can be used in accordance with the present invention, the preferred control consists of a microprocessor control system that utilizes the Versa Module Europe (VME) standard card cage system. The VME system can use GS DOS, which is an industrial version of DOS, Windows and/or a number of standard software packages and components such as touch screens, modems and other hardware devices. This microprocessor control system provides the advantage of logically grouping by function the input/output screens that prompt the operator through start-ups, changes and adjustments. The operating system also enables the use of real-time statistics and diagnostics which permits the operator to perform weighing and cycle analyses.

BRIEF DESCRIPTION OF THE DRAWINGS

The drawings illustrate an embodiment of the invention in which:

FIG. 1 is a perspective view of the form-fill-seal machine as seen from the front upper right.

FIG. 2 is an isolated perspective view of the seam sealer and its mounting mechanism as seen from the upper front right.

FIG. 12 is an isolated perspective view of the sealing jaw mechanism as seen from the back upper right.

FIG. 13 is an isolated right side view of the sealing jaw mechanism.

FIG. 14 is an isolated exploded perspective view of the sealing jaw mechanism as seen from the front upper left.

DETAILED DESCRIPTION OF THE PREFERRED EMBODIMENT

Figure 3:
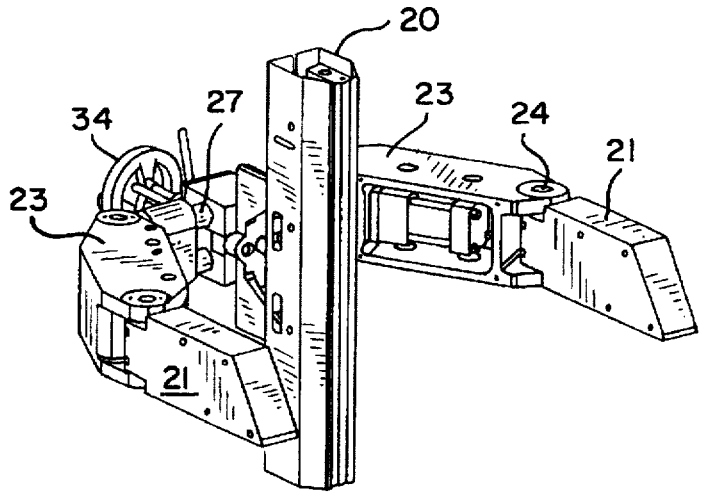
FIG. 3 is an isolated perspective view of the seam sealer and its mounting mechanism as seen from the upper back right.

FIG. 1 is a perspective view of the form-fill-seal machine 10 as seen from the front upper right. The sealing jaw mechanism 100, illustrated in FIGS. 12 through 20 is not mounted on the machine as seen in FIG. 1.

The form-fill-seal machine 10 is built around a frame 12 that includes base plates 13 that rest upon the floor and support vertical columns 14–17. Vertical columns 14 and 16 are connected by a lower support member 2 and an upper support member 4. Vertical columns 15 and 17 are connected by a lower support member 3 and an upper support member 5. Support members 2–5 extend in the fore and aft direction of the form-fill-seal machine 10. The fore and aft extending upper support members 4 and 5 are connected by a forward support member 6 and a rearward support member 7. The fore and aft extending lower support members 2 and 3 are connected by a forward support member 8, a mid support member 9 and a rear support member 11. Right and a left parallelogram shaped plates, 18 and 19 (shown in FIGS. 8 and 9) respectively, are secured to and extend upward and forward from the forward support member 8 and the mid support member 9.

As further shown in FIG. 2, the seam sealer 20 is supported by mounting members 21 that are secured to the outer surfaces of plates 18 and 19 by nuts and bolts. The mounting members 21 include vertical bores at their free ends through which link members 23 are pivotally connected about vertical pivots 24. The other ends of link members 23 are pivotally connected about vertical pivots 25 to mounting members 26. There are spring biased ball detents that hold the link members 23 and mounting members 26 in the relative positions shown in FIGS. 1–3. The ball detents can be released upon the application of pressure to move mounting members 26 relative to the link members 23. The other ends of mounting members 26 each have a pair of vertically spaced rods 27 extending therefrom. The pairs of vertically spaced rods 27 extend into opposite sides of seam sealer mount 28 and can be reliably locked thereto. The seam sealer 20 is carried by the back (as seen in FIGS. 2 and 3) of the seam sealer mount 28. There are two rotating lock mechanisms 30 and 32 on the front of the seam sealer mount 28. The rotating lock mechanisms 30 and 32 each have a pair of arms 31 and 33 respectively that can be grasped by the operator to screw the rotating lock mechanisms 30 and 32 in and out. When rotating lock mechanism 30 is screwed in, it locks the left-right position of the seam sealer 20. When rotating lock mechanism 32 is screwed in, it locks the in-out position of the seam sealer 20 for different bag sizes.

The seam sealer mount 28 also supports a crank mechanism 34 that is used to adjust and secure the seam sealer 20 at the desired depth or in-out position.

If it is desired to replace the change parts assembly for one that will produce a different size package, the left mounting member 26 is released from the seam sealer mount 28 such that the right link member 23 is free to pivot about vertical pivots 24 and 25. This allows the entire seam sealer 20 and its mounting mechanism to be pivoted out of their operative positions to an inoperative position outwardly of the right parallelogram shaped plate 18.

Standard form-fill-seal machines are adaptable to produce packages of various shapes and sizes by changing the forming tube and forming shoulder. The forming shoulder and tube assembly must however be mounted relative to other components of the machine with precision to ensure proper operation. Changing a form-fill-seal machine from one size package to another is, in the conventional machine, a time consuming task that requires a highly skilled machine operator. During the change over, the machine is of course not operating and thus the production from the machine is lost. An aspect of this invention is to provide a change part assembly 200 that can be removed quickly and easily and replaced when it is desired to change the package size being run on the form-fill-seal machine.

Figure 4:
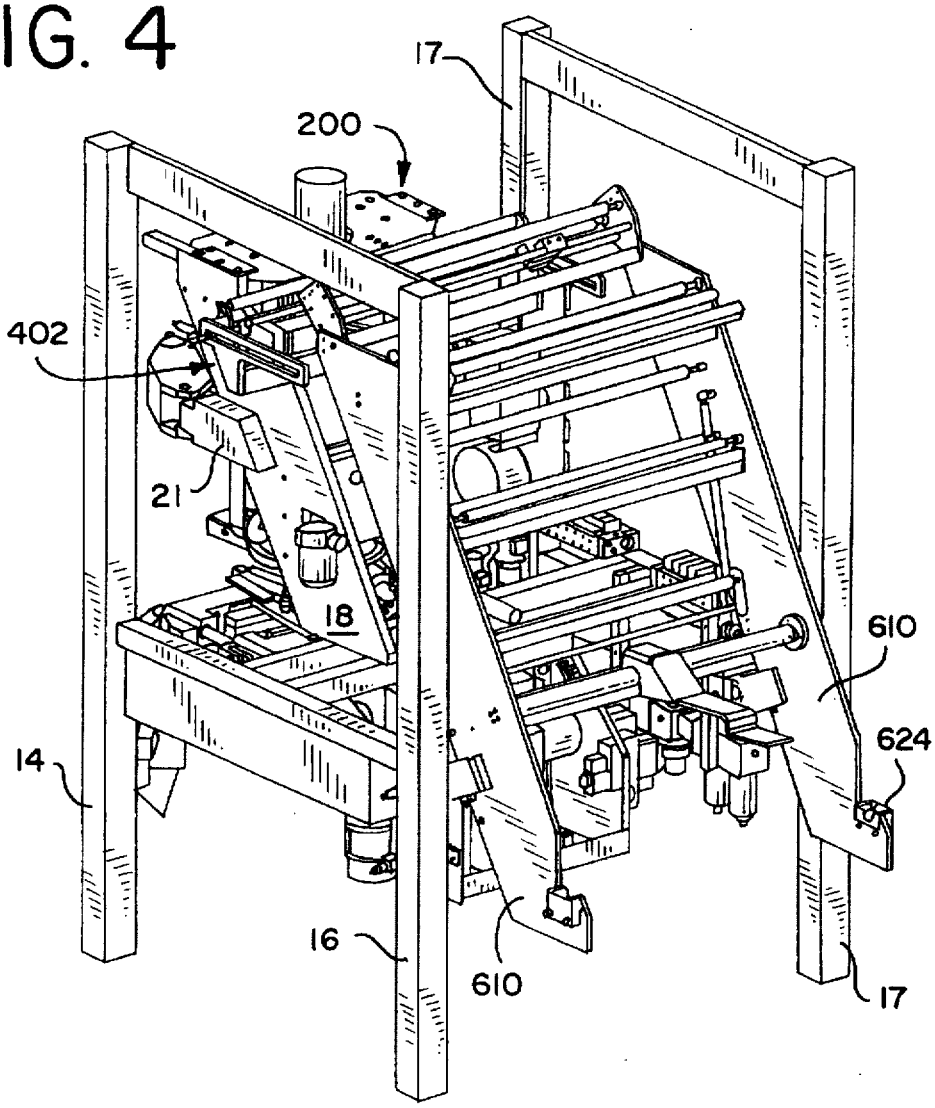
FIG. 4 is a perspective view of the form-fill-seal machine as seen from the front upper left.
Figure 6:
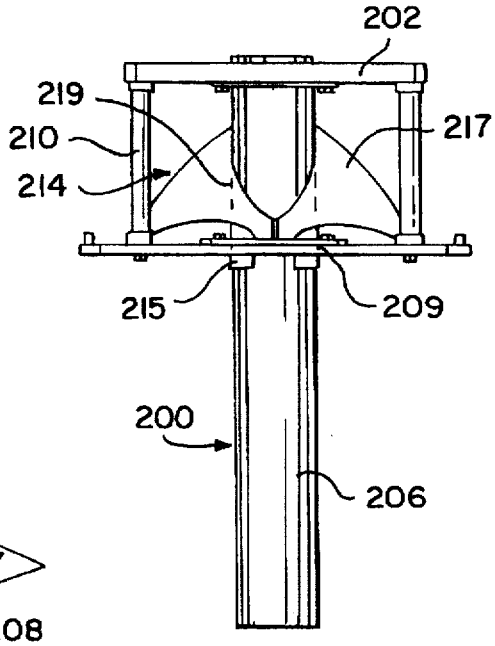
FIG. 6 is a front view of the change part mechanism.
Figure 7:
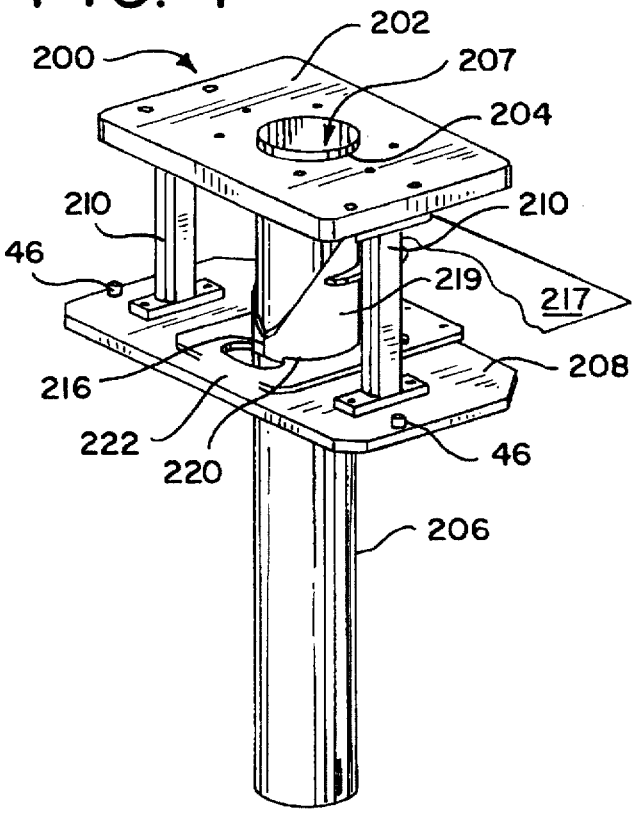
FIG. 7 is an isolated perspective view of the change part mechanism as seen from the upper right.

The change part assembly 200 is seen mounted on the machine in FIGS. 1 and 4 and isolated in FIGS. 6 and 7. The change part assembly 200 includes a forming tube mounting plate 202 that has a faceted opening 204 formed therein. The forming tube 206 is secured to the forming tube mounting plate 202 within the facetted opening 204. The product to be sealed in the bags is loaded through the open end 207 of the forming tube 206. For a more detailed disclosure of a forming tube having a plurality of longitudinally extending flat surfaces, of the type disclosed herein, reference may be had to U.S. Pat. No. 5,255,497, which patent is hereby included by reference as a part of this disclosure. A lower plate 208 is connected to forming tube mounting plate 202 by a pair of columns 210. Lower plate 208 has an aperture 209 (see FIG. 6) formed therein that is larger than the forming tube 206. The forming shoulder 214 is constructed by welding the shoulder portion 217 (see FIG. 6) to the collar shaped body portion 219 (see FIGS. 1, 4, 6 and 7). The shoulder portion 217 is not included in FIGS. 1 and 4, to more clearly show the surrounding components, and in FIG. 7 only the back edge portion is illustrated. The forming shoulder 214 surrounds the forming tube and is spaced therefrom a sufficient distance to permit the film from which the package is formed to freely pass between the outer surface of the forming tube and the inner surface of the forming shoulder 214. The upper edge of the forming shoulder 214 dips down forming a V-shaped depression that converges to a vertical slot 216. The forming shoulder 214 is secured to a shoulder plate 218 that has a circular aperture 220 formed therein. An oval shaped aperture 222 is formed in the shoulder plate 218 adjacent the vertical slot 216. The shoulder plate 218 is secured to the lower plate 208. As is well known in the art, the film from which the package is formed is fed to the forming tube 206 from the film roll 625 that is located at the back of the form-feed-seal machine 10 as a flat sheet and is formed into a tubular shape by the forming shoulder 214. The open edges of the tubular shaped film extends through the vertically extending slot 216 and are sealed by the seam sealer 20.

As best seen in FIG. 6 the bottom rim portion 215 of forming shoulder 214 extends below lower plate 208. The change part mounting mechanism includes aligning grooves and pins that insure the precise mounting of the change part 200 on the machine relative to the right 302 and left 303 vacuum drive belt assemblies. Numerous change part assemblies 200, of different shapes and sizes, can be mounted on the machine. However, the gap between the forming shoulder 214 and the forming tube 206 is consistent and the ratio of the outer dimension of the forming shoulder 214 and the forming tube 206 is consistent. Thus, the bottom rim portion 215 of each change part 200 includes reference surfaces that establishes a reference for that particular change part for a purpose to be further discussed.

Figure 8:
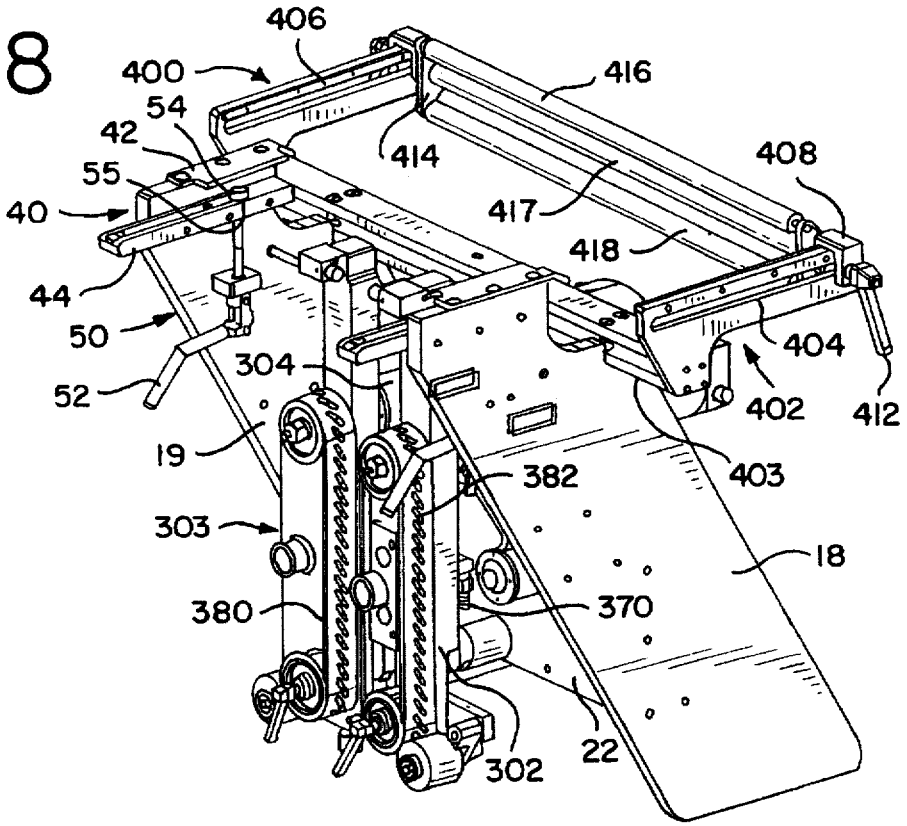
FIG. 8 is an isolated perspective view of the vacuum pull belt arrangement as seen from the front upper right.

Referring now to FIGS. 6, 7 and 8 the mounting of a change part assembly 200 on the machine will be discussed. The lower plate 208 of the change part assembly 200 is slid into slots 40 that are defined by the parallelogram shaped plates 18 and 19, upper plates 42 secured to the upper edge of plates 18 and 19 and bars 44 that are secured to the inner surfaces of the plates 18 and 19. The lower plate 208 has an upwardly projecting stud 46 on each edge that will slide into the slots 40. The upper plates 42 have notches 48 formed in their leading edges that are dimensioned to receive the studs 46. Toggle lock mechanisms 50, including handles 52 are mounted on the inner surface of each parallelogram shaped plates 18 and 19 below the bars 44. The toggle lock mechanisms 50 include a rod 54 having a flat end that extends through cylindrical openings 55 formed in the bars 44. After, the edges of bottom plate 208 are slid into slots 40 to the point where studs 46 are engaged in the notches 48, the handles 52 are moved to the locked position which causes rods 54 to extend upwardly through cylindrical openings 55 and secure the change part assembly 200 in place in the grooves 40. All components of this mounting arrangement are machined to precision and, as a result, the change part assembly 200 can be quickly and easily mounted on the machine in the correct position. This mounting arrangement provides a mounting mechanism that has a level of precision that permits a change part assembly 200 to be slid into the slots 40 and secured in place by the toggle lock mechanisms 50, and no further adjustment is required. This is a result of not only the precision machining of all mounting components but also the fact that the change part assembly 200 is mounted at a location that is very close to the film belt drive assembly 300 and there are very few parts between the precision mount and the forming tube 206. In the prior art, the mounting members for the change part assemblies can not be relied upon to be consistently located. This is a result of their being supported through a series of connected parts, each of which has a manufacturing tolerance. As a result, the change part assemblies must be carefully adjusted and leveled with shims and the like. The mounting arrangement disclosed herein eliminates such steps by mounting the change part very close to the pull belts, greatly reducing the number of pieces therebetween. Furthermore, all engaging components of the change part mounting arrangement are precision machined surfaces. The range of variability has been greatly reduced and the interchangeability of the change parts has been greatly enhanced.

Figure 9:
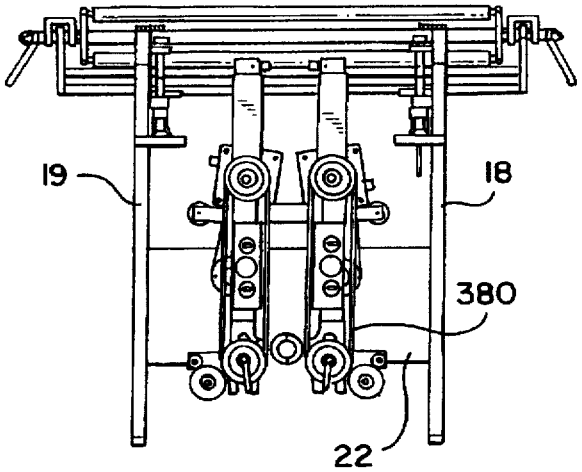
FIG. 9 is a front view of the vacuum pull belt arrangement that is seen in FIG. 8.
Figure 10:
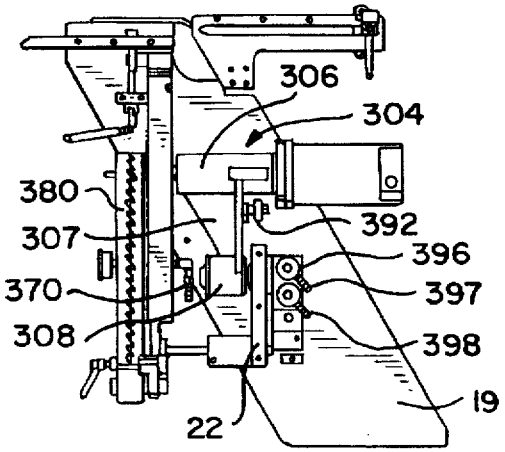
FIG. 10 is a side view showing the vacuum pull belt arrangement seen in FIG. 8.
Figure 11:
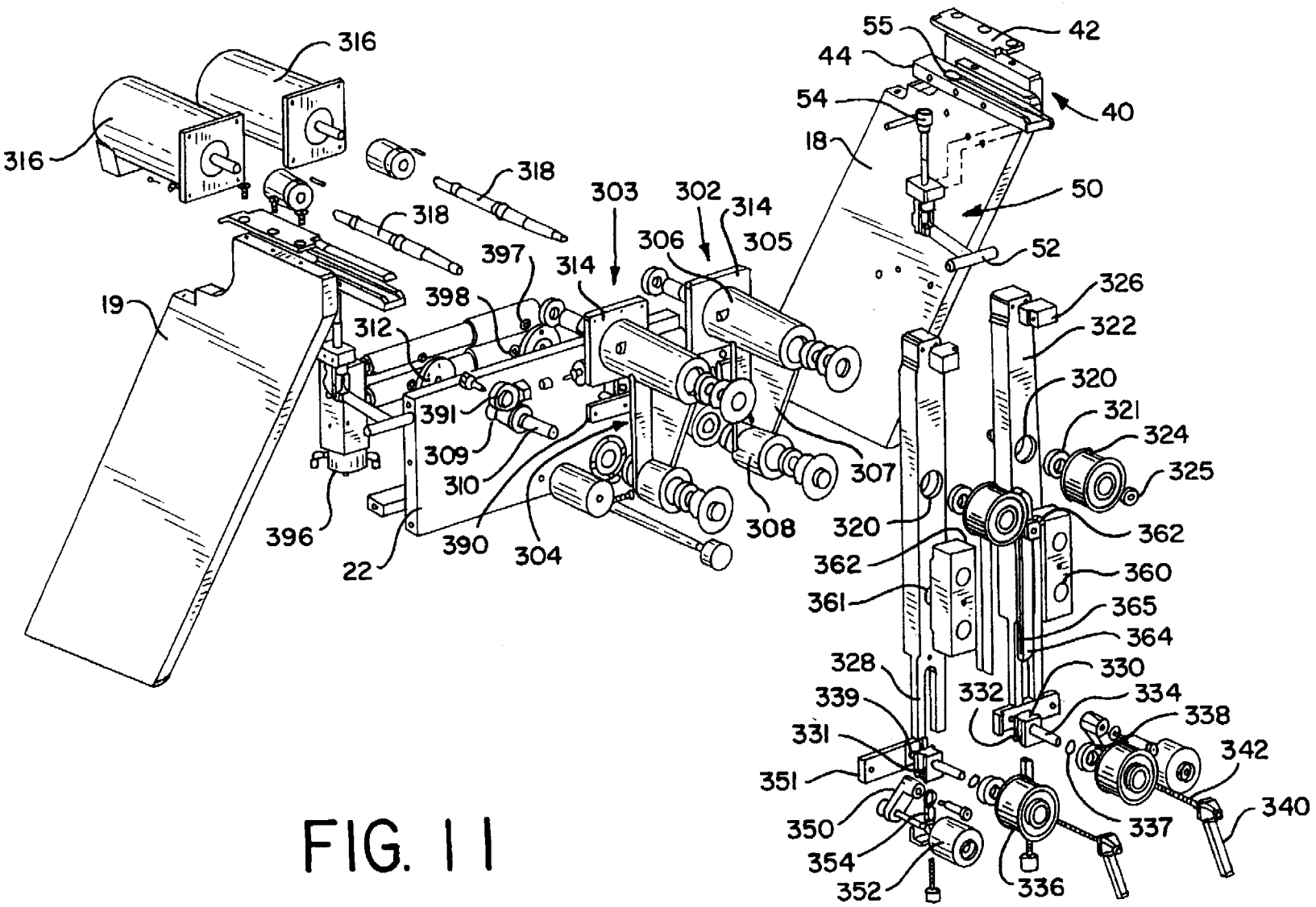
FIG. 11 is an exploded view of the film belt drive assembly.

As best seen in FIGS. 9, 10 and 11 a frame member 22, that lies in a vertically extending plane, is connected at its ends to the parallelogram shaped plates 18 and 19. The film belt drive assembly 300 is mounted on frame member 22. The film belt drive assembly 300 consists of a right 302 and a left 303 vacuum drive belt assembly. The right 302 and left 303 vacuum drive belt assemblies are virtual mirror images of each other and thus they will be described only once. The reference numbers for the various parts of the vacuum drive belts are divided between the right and the left assemblies to avoid crowding.

The vacuum drive belt assemblies 302,303 will be described with reference to FIGS. 7–11. Each vacuum drive belt unit comprises a casting or mounting member 304 having an upper cylindrical member 306 and a lower cylindrical member 308 that are interconnected by an arm 305 that is reinforced by a web 307. The casting 304 is pivotally mounted on the vertical frame member 22 about lower cylindrical member 308. This mounting includes a shaft 310 that extends through an aperture 309 that is formed in frame member 22. The shaft 310 is secured to the back surface of vertical frame member 22 by a retainer flange 312. The rear end of upper cylindrical member 306 carries a shoulder plate 314 to which is secured a stepper motor 316. The stepper motors 316 drives the film drive shaft 318 that extends through the upper cylindrical member 306. The drive shafts 318 extends through openings 320 formed in the pulley supports 322 and the pulley drives 324 are secured at their free ends by lock nuts 325.

A biasing device is provided between the right 302 and left 303 vacuum drive belt assemblies for causing these assemblies to move relative to each other. This biasing device includes mounting arms 390 that are secured to the arms 305 of the vacuum drive belt assemblies 302, 303 and an air cylinder 392. The rod end 391 of air cylinder 392 is connected to mounting arm 390 of vacuum drive belt assembly 303 and the head end of cylinder 392 is connected to the mounting arm 390 of vacuum drive belt assembly 302. When cylinder 392 is expanded or retracted, the castings 304 are caused to pivot about lower cylindrical member 308. When cylinder 392 is expanded, the distance between the pulley supports 322 increases and when the cylinder 392 is retracted the distance between the pulley supports 322 decreases.

While setting the machine up for a different size package and during normal operation of the machine, cylinder 392 is biased in the direction to retract and thus cause the pulley supports 322 to move toward each other. After a change part assembly 200 has been mounted and secured in place, the cylinder 392 is retracted, causing the pulley supports 322 to move toward each other. As the pulley supports 322 move toward each other the pull stops 326 approach the bottom rim portion 215 of forming shoulder 214. When the pull stops 326 engage the reference surfaces of the rim portion 215 of forming shoulder 214, the movement of the upper ends of pulley supports 322 stop. However, the lower ends of pulley supports 322 are still free to move. The pulley supports pivot about the engagement point of the pull stops 326 with the bottom rim portion 215 of the forming shoulder 214. This movement is stopped when the portions of continuous belts 380 that are overlaying the driven pulleys 336 make contact with the lower portion of the forming tube 206. The pull stops 326 and the bottom rim portion 215 of the forming shoulder 214 are formed with precision to insure that the surface of the continuous belts 380 are spaced from the surface of the forming tube 206 a distance of 0.02 of an inch at the pulley drives 324. Thus, there is a gap at the leading edge of the continuous belts 380 relative to the forming tube 206. A precession adjustment is built into the pull stops 326 to achieve more precise spacing, if required. This 0.02 of an inch spacing of the continuous belts 380 from the forming tube enables the film to be held against the continuous belts 380 by vacuum and out of engagement with the forming tube. This eliminates frictional drag between the forming tube 206 and the film. In the prior art, vacuum pull belts were mounted on housings that were slid back and forth on shafts. Accurate stop mechanisms were required to secure the pull belts such that there was a very small gap between the surface of the pull belts and the forming tube. Accomplishing this adjustment is a very tedious and time consuming task. Although in applicant's device there is line contact of the continuous belts 380 with the forming tube 206 along the driven pulleys 336, this contact results in minimal frictional drag and can be tolerated. As a result of this arrangement an unlimited number of change parts, of different shapes and sizes, can be used on a machine and the vacuum belt assemblies 302 and 303 will always be in proper adjustment because the proper adjustment is built into the change part itself.

The opening 320 carries a bearing 321 through which drive shaft 318 extends. The pulley support 322 extends upwardly from opening 320 and has pull stop 326 secured to its upper free end. The pulley support 322 also extends downwardly from opening 320 and terminates in a two-pronged fork 328. The prongs of the two pronged fork have square cross sections. An idler guide mount 330 having a pair of vertically extending grooves 331 and 332 formed therein and a pivot shaft 334 extending therefrom. The groves 331 and 332 of idler guide mount 330 receive the prongs 328 and provide a guide for vertical sliding of the idler guide mount 330. The driven pulley 336 is rotatably carried by pivot shaft 334 on idler bushing 337 and bearing 338. An adjusting handle 340 having a threaded shaft 342 extending therefrom extends through the driven pulley 336 and the pivot shaft 334 and is threaded into a threaded opening 339 formed in an idler mounting arm 342. The adjusting handle 340 can be loosened and then tightened when it is desired to adjust the position of the idler guide mount 330 on the prongs 328. The rear surface of the idler guide mount extends into a vertical groove formed in the idler mounting arm which allows the front surface of the idler mounting arm to engage the rear surfaces of forks 328 to fictionally secure the idler guide mount 330 in a selected location.

A brush mounting arm 350 is pivotally mounted at the free end of the idler mounting arm 351 and carries a pivotally mounted brush 352 at its free end.

A tension adapter 354 having a square cross section is provided for adjusting the tension in the pull belts 380. A threaded shaft having a thumb screw head is provided that permits manual adjustment of the tension adapted 354. The tension adapted 354 has a built in clutch that functions to limit the maximum amount of tension that can be applied to the pull belts 380.

Film drive mounting nozzles 360 are secured to the pulley supports 322 over openings 361 that are located between the openings 320 and the two pronged forks 328. A vertically extending slot 362 is formed in the vertical side of drive mounting nozzles 360 that faces the other vacuum feed drive assembly 302 or 303. A film drive nozzle 364 is secured in vertically extending slot 362. The film drive nozzle 364 has a vertically extending slotted opening 365 formed in its outer surface. There is an opening (not shown) in the rear surface of film drive mounting nozzle 360, aligned with opening 361, that communicates with a chamber (not shown) formed in film drive mounting nozzle 360. The chamber communicates with a slotted opening formed in the base of slot 362. The slotted opening formed in the base of slot 362 communicates with an opening or openings formed in the base of film drive nozzle 364. A vacuum fitting 370, see FIG. 10, extends through opening 361 and is secured in the aligned opening formed in the film drive mounting nozzle 360, such that when a vacuum hose is connected to vacuum fitting 370 a vacuum is created along the vertically extending slotted opening 365.

A continuous belt 380, see FIG. 8, having a series of diagonal slots 382 formed therein along its entire length, is mounted over the pulley drive 324 and the driven pulley 336. The continuous belt 380 passes over the vertically extending slotted opening 365 formed in film drive nozzle 364. During the time that a diagonal slot 382 is moving along the vertically extending slotted opening 365 there is a vacuum on the outer surface of the continuous belt adjacent this particular diagonal slot 382. As will be further discussed, the film from which the package is being formed is located adjacent the continuous belt 380 and the vacuum appearing through the diagonal slots 382 holds the film against the continuous belt 380 and moves the film downwardly along with continuous belt 380.

As is best seen in FIGS. 10 and 11, a vacuum generator assembly 396, that is mounted on the rear surface of vertically extending frame member 22, includes vacuum outlets 397 and 398 that are connected by hoses to the vacuum fittings 370 carried by the vacuum drive belt assemblies 302, 303.

Figure 21:
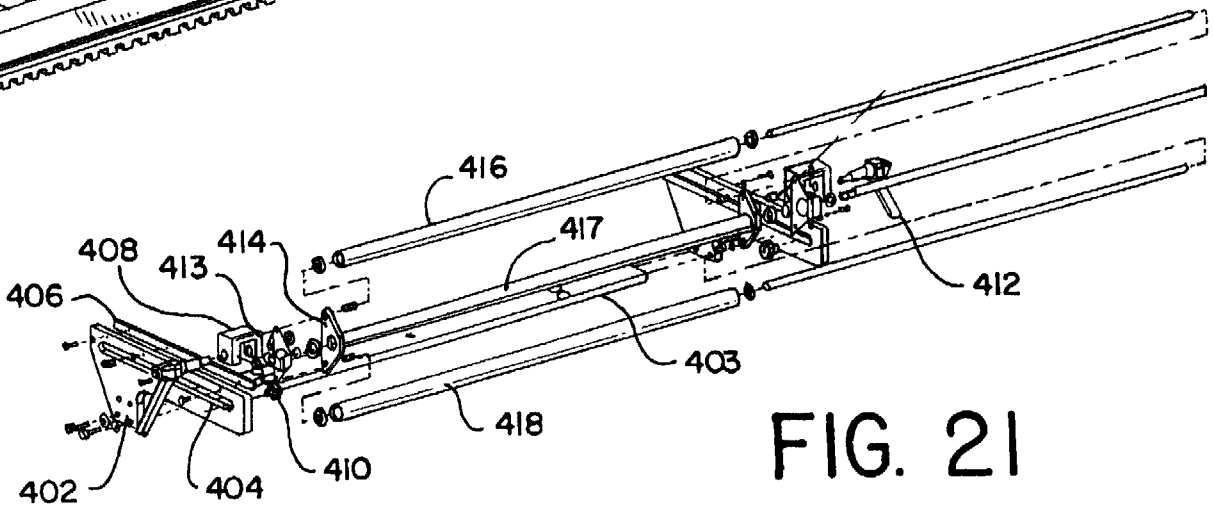
FIG. 21 is an exploded perspective view of the tension roller assembly.

The tension roller assembly 400 is shown in FIG. 8 mounted on the upper rear edges of the parallelogram shaped plates 18 and 19 and as an exploded view in FIG. 21. The assembly 400 functions to control the tension in, and take slack out of, the film immediately before it reaches the forming shoulder 214. It is important that the film lies flat on the surface of the forming shoulder 214 and there are no air bubbles between the film and the surface of the forming shoulder 214. The assembly 400 includes rearwardly extending horizontal brackets 402 on each side that are connected by a tie bar 403. Brackets 402 have horizontal slots 404 formed therein and gear racks 406 secured to the brackets 402 along the upper edges of the slots. A roller frame clamp 408 is slidable along the upper edge of the brackets 402. A spur gear 410 is supported on each roller frame clamp 408 that meshes with its corresponding gear rack 406. The gear racks 406 and meshing spur gears 410 cause the roller frame clamp 408 to move in unison along the brackets 402. A handle 412, that is connected to a tension retainer mechanism 413 is provided for each of the roller frame clamps 408. Handles 412 can be turned to secure or release the roller frame clamp 408 at selected locations along the brackets 402. Triangular shaped plates 414 are connected by a pivot shaft or torque tube 417. The pivot shaft or torque tube 417 is carried by the roller frame clamp 408 and can be pivoted relative thereto and secured in a selected adjusted position by handles 412. A pair of horizontally extending rollers 416 and 418 are carried by the triangular shaped plates 414. The film extending from the rear of the machine over the top roller 416 and then extends back and under the lower roller 418 from which it extends to the back edge of the shoulder portion 217 (see FIG. 7) of the forming shoulder 214. The roller frame clamps 408 and triangular shaped plates 414 are adjusted such that the film that extends from the lower roller 418 to the lower edge of the shoulder 214 has a slight negative angle with the surface of the shoulder 214 which causes the film to maintain contact with the shoulder and eliminate wrinkles in the film. The roller frame clamp 408 can be adjusted along the brackets 402 and secured at a location at which the lower rod 418 is properly located relative to the forming shoulder 214 to insure that there is no slack in the film as it encounters the forming shoulder 214 and there are no air bubbles between the film and the surface of the forming shoulder 214.

The sealing jaw mechanism 100 is Shown in FIGS. 12–20. A cast housing 500 includes bearings for an oscillating shaft 502. The cast housing 500 is secured by nuts and bolts (not shown) to the lower support members 2 and 3 (see FIG. 1). The oscillating shaft 502 is driven by rotating shaft 505 through a link 506 and a crank 504. The link 506 is pivotally connected at one end to the rotating crank 504 and at its other end to the free end of a lever arm 512 that is carried by the oscillating shaft 502. The rotating crank 504 is carried by the rotating shaft 505 that is journaled in bearings 514 carried by mounting flanges 515 that are secured to the cast housing 500. The rotating shaft 505 is driven by a servo motor 508 through a gear box 510. When the servo motor 508 is actuated the crank 504 transmits motion through link 506 to the lever arm 512 which causes shaft 502 to oscillate. Both ends of shaft 502 carries an arm 516 that extends in both directions from the axis of shaft 502. Rods 518 extend from one end of each arm 516 to the front slide bracket 520 and additional rods 519 extends from the other ends of each arm 516 to the rear slide bracket 540.

A pair of guide rods 560 are fixed to the cast housing 500 and extend horizontally toward the front of the machine. The forward front ends of guide rods 560 are supported on the frame of the machine 10 to prevent vibration and deflection. The guide rods 560 are circular in cross section and are polished to provide low friction sliding surfaces. The front and rear slide brackets 520 and 540 have cylindrical shaped bores 521 and 553 respectfully formed therein that are dimensioned to receive the guide rods 560. Oscillation of shaft 502 causes the front and rear slide brackets 520 and 540 to slide toward each other and away from each other on the guide rods 560. Actuation of the servo motor 508 at the proper time in the machine cycle controls the timing of the movement of the front and rear slide brackets 520 and 540. The servo motor 508 is actuated in response to signals from the operating system.

As seen in FIG. 14 a front and a back bag deflator 590 are located below the bottom gripper bar assemblies 524 and 544 through mounting brackets 592. As the sealing jaw mechanism 100 begin to close the bag deflators 590 contact the filled bag below the area in which the bag will be sealed. The bag deflators 590 flatten the tubular shaped bag and force the air out. The bag deflators 590 are removable and can be removed when not needed.

Figure 15:
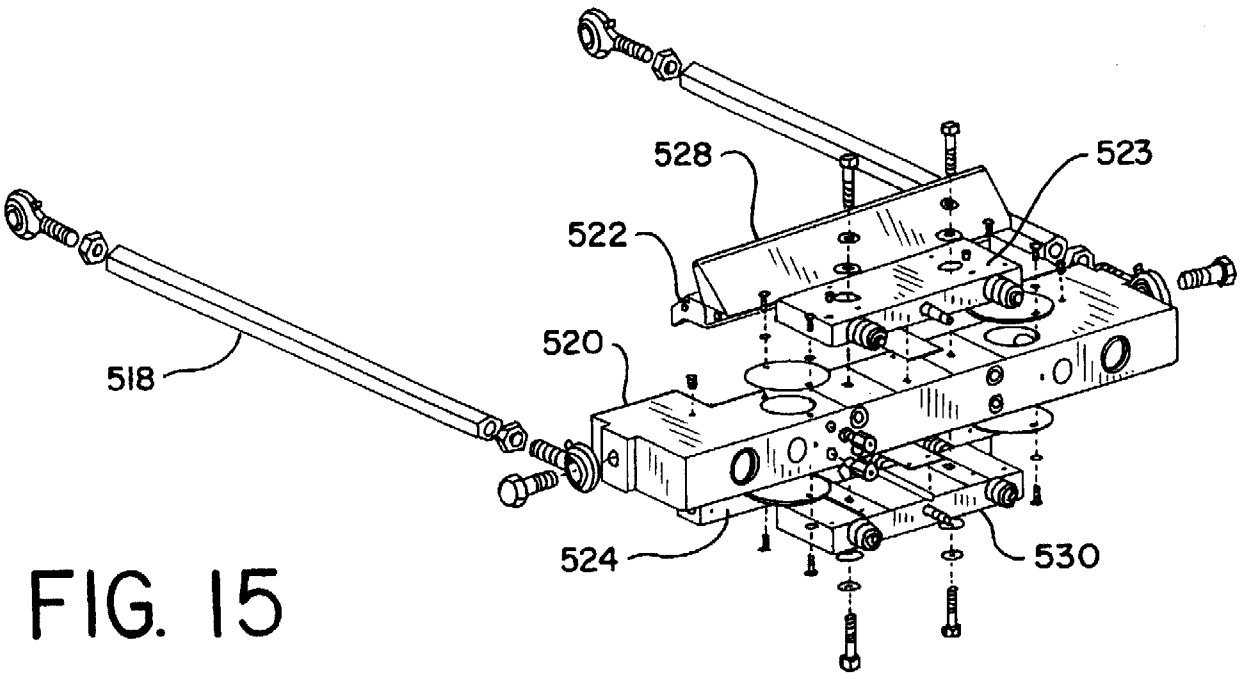
FIG. 15 is an exploded perspective view of the front slide bracket and top and bottom gripper bar assemblies.
Figure 16:
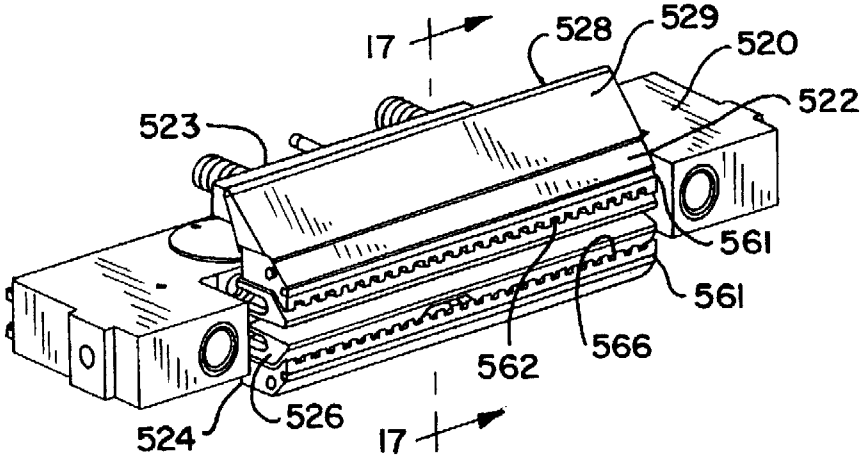
FIG. 16 is an isolated perspective view of the front slide bracket and front jaw assembly.
Figure 17:
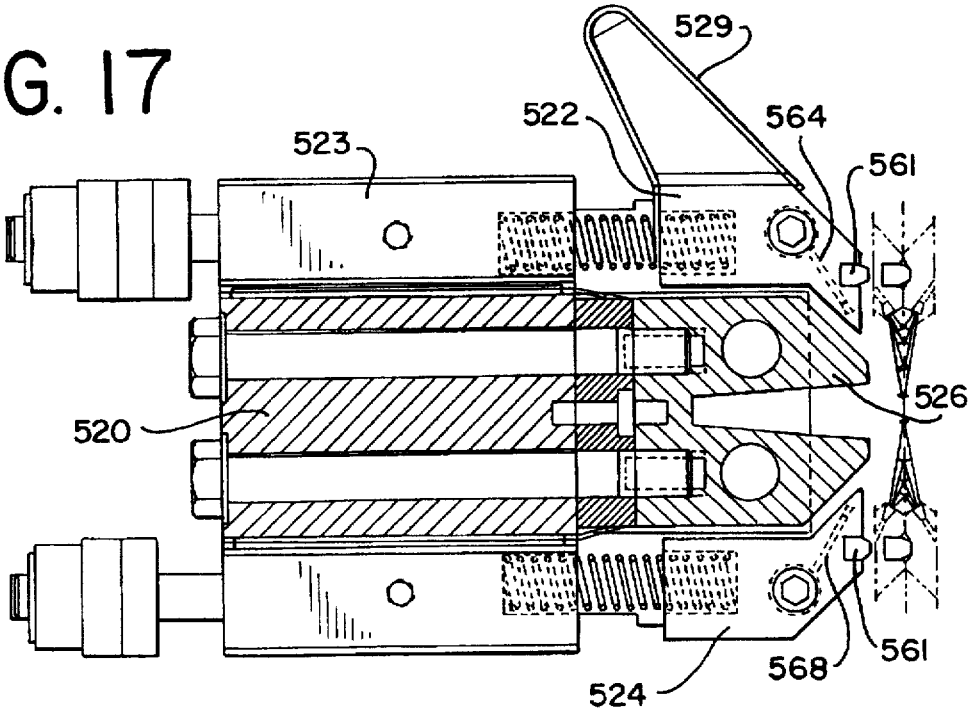
FIG. 17 is a cross section view of the front slide bracket and front jaw assembly taken along lines 17—17 of FIG. 16.

As seen in FIGS. 13, 14 and 15 the front slide bracket 520 has a top gripper bar assembly 522 and a bottom gripper bar assembly 524. The top gripper bar assembly 522 includes a gripper bracket 523 that is fixed to the upper surface of the front slide bracket 520. A gripper bar deflector 528 is carried by the top surface of the gripper bar assembly 522. The gripper bar deflector 528 includes an inclined surface 529 that extends up and toward the front of the machine. When the front and rear slide brackets 520 and 540 are located close to each other the inclined surface 529 engages the bag immediately above the area where the cross seam will be formed and functions to support the weight of the product that will be deposited into the bag. One purpose of this is to prevent the product from contacting the seal while it is being formed.

The rear edges of the top 522 and bottom 524 gripper bar assemblies, that are carried by the front slide bracket 520, and the top 542 and bottom 544 gripper bar assemblies, that are carried by the rear slide bracket 540, (see FIGS. 16, 17, 18 and 19) have longitudinally extending grooves formed therein that carry rubber strips 561. The rubber strips 561 in the front and back slide brackets are aligned with each other. Rubber strips 561 engage the surface of the bag above and below the area in which the seal is to be formed. The lower edges of the top 522 and bottom 524 gripper bar assemblies have a series of notches 562 and 566 respectfully formed therealong. The gripper bar assemblies 522, 524 have air exit apertures 564 and 568 respectively formed therein at the bases of the notches 562 and 566. The air that exits through apertures 564 and 568 flows through the notches 562 and 566 toward the seal that has been formed and functions to cool or chill the seal.

The rear slide bracket 540 has a pair of fore and aft extending apertures 570 formed therein. Cylinder mounting brackets 572 are secured along the rear edge of the slide bracket 540 about the openings or apertures 570. Air cylinders 574 are mounted on cylinder mounting brackets 572 with their rods extending toward the front edge of the rear slide bracket 540. A knife clevis support 576 is secured to the front edge of the rear slide bracket 540 below the opening of apertures 570. A knife clevis 578, that is supported by knife clevis support 576, extends into each apertures 570 and is connected to the rod of an air cylinder 574. A horizontally extending knife 580 is connected at each end to one of the knife clevises 578. The knife 580 is extended and retracted in response to the actuation of air cylinders 574. When knife 580 is in its retracted position it is located in a slot 582 formed in the rear jaw assembly 556. The slot 582 extends between the upper and lower heating elements 584 of the jaw assembly 556.

The front slide bracket 520 has a jaw assembly 526 extending across its rear horizontal edge. The jaw assembly 526 has an upper and a lower heating elements that function to producing the seal when the jaw assemblies are engaged. The jaw assembly 526 include slide rods 525 that are fixed thereto and compression springs 527 that bias the jaw assembly away from the front slide bracket 520.

The bottom gripper bar assembly 524 (see FIG. 15) is mounted on the lower surface of the front slide bracket 520 and includes a gripper bracket 530 and a gripper bar 534. The gripper bracket 530 receives slide rods 532 that are fixed to the gripper bar 534. Compression springs 536 bias the gripper bar 534 away from the gripper bracket 530 toward the back of the machine.

It should be noted that although the top gripper bar assembly 522 is fixed relative to the front slide bracket 520 the jaw assembly 526 can move relative to the front slide bracket 520.

As seen in FIGS. 12, 13, 14 and 18, the rear slide bracket 540 has a top gripper bar assembly 542 and a bottom gripper bar assembly 544. The top gripper bar assembly 542 includes a gripper bracket 554 that is secured to the top surface of rear slide bracket 540. The gripper bar assembly 542 includes slide rods 545 that are slidably received in bores 541 formed in gripper bracket 554. The slide rods 545 extend through the gripper bracket 554 and receive a plurality of cylindrical cushions 537, a clamp color 538 and a ring grip 539. Compression springs 543 bias the gripper bar assembly 542 toward the front slide bracket 520.

The bottom gripper bar assembly 544 includes a gripper bracket 547 that is secured to the bottom surface of rear slide bracket 540. The gripper bar assembly 544 includes has slide rods 552 that are slidably received in the gripper bracket 547. Compression springs 550 bias the gripper bar assembly 544 toward the front slide bracket 520.

Figure 18:
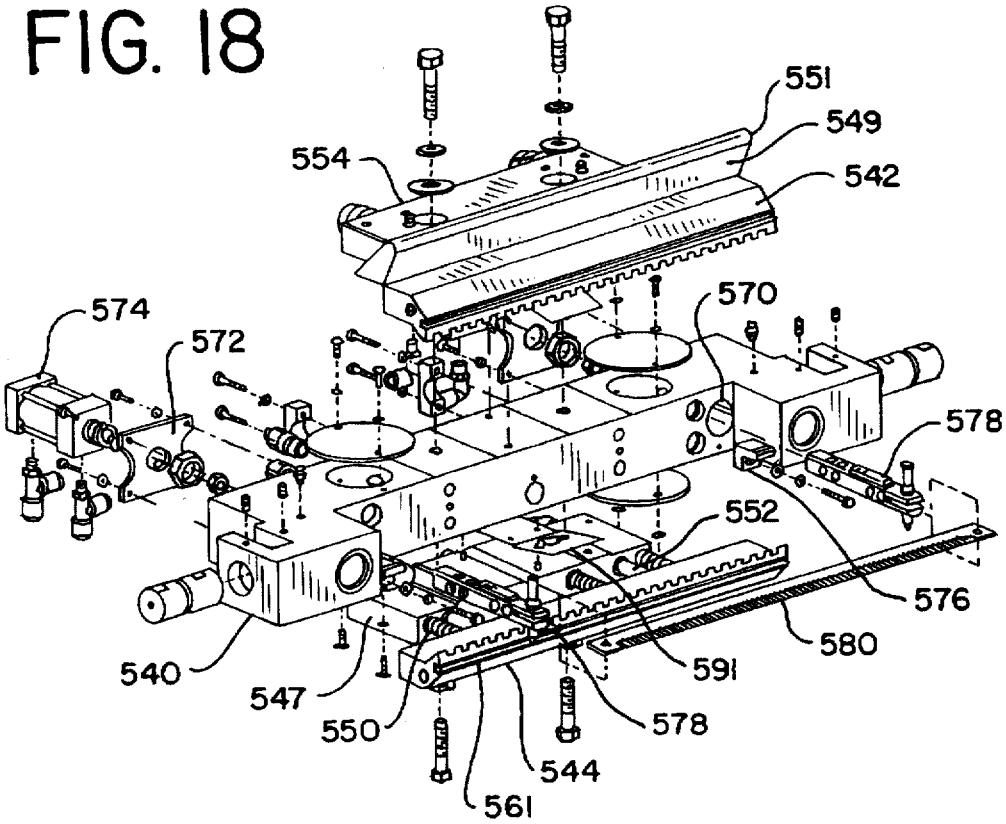
FIG. 18 is an exploded perspective view of the rear slide bracket and top and bottom gripper bar assemblies.
Figure 20:
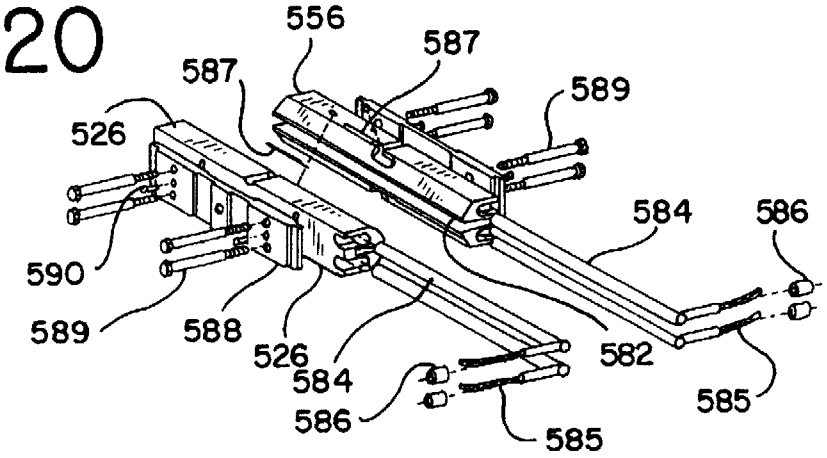
FIG. 20 is an exploded perspective view of the front and rear jaw assemblies.
Figure 19:
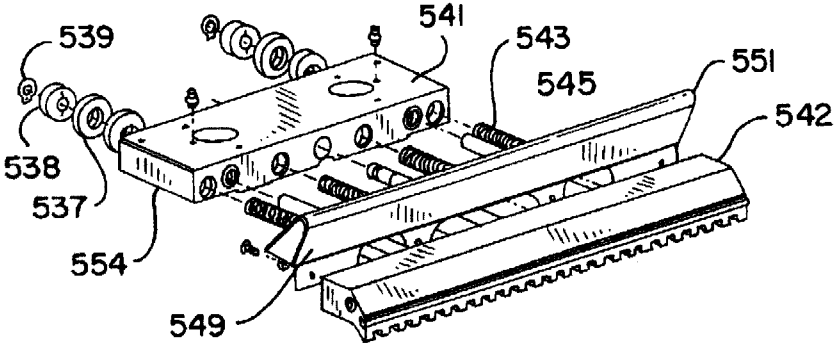
FIG. 19 is an exploded perspective view of the top rear gripper bar assembly and gripper bar deflector.

The top gripper bar assembly 542, as best seen in FIGS. 18 and 19, includes a gripper bar deflector 551 that is carried by the gripper bear assembly 542. The gripper bar deflector 551 includes an inclined surface 549 that extends up and toward the back of the machine. It should be noted that in FIGS. 18 and 19 the gripper bar deflector 551 is tilted forward rather than in its normal working position. In this tilted position the inclined surface 549 extends up and toward the front rather than the back as it does in its normal working position. When the front and rear slide brackets 520 and 540 are located close to each other the inclined surfaces 529 and 549 engages the bag on opposite sides immediately above the area where the cross seam is being formed and functions to support the weight of the product that is deposited into the bag. One purpose of this is to prevent the product from contacting the seal while it is being formed.

The back slide bracket 540 has a jaw assembly 556 extending across its front horizontal edge. The jaw assembly 556 has an upper and a lower heating element 584 that function to increase the temperature in the jaw assembly 556 and thus producing the seal when jaw assemblies 526 and 556 are engaged. The heating elements are energized through electric wires 585 that extend through sleeves 586. A thermocouple 587, that is supported on a thermocouple retainer 591 (see FIG. 18), is provide to measure and control the temperature of the jaw assembly. The jaw assembly 556 is aligned by locating pins 590 and secured in place by bolts 589 that extend through the slide bracket 540 the spacer 588 and then into the jaw assembly 556. This description and the reference numbers apply equally to the jaw assembly 526 that is secured to the front slide bracket 520.

The sequence of the operation of the sealing assemblies or jaws 526, grippers and cooling air will now be discussed. As front slide bracket 520 and rear slide bracket 540 begin moving toward each other the jaw assemblies 526 and 556 begins closing. The gripper carried by the front 520 and rear 540 slide brackets are biased toward each other and as a result make the initial contact with the film. The film must be stationary at the time the grippers make contact. When initial contact is made by the grippers, the inclined sheet metal surfaces are in a position to accept and support a charge of product that is discharge from above and prevent the product from entering the area of the film to be sealed. As the slide brackets 520 and 540 continue to move toward each other, after initial contact by the grippers, the springs that bias the grippers out to their extended position become compressed and the jaws 526 and 556 move toward each other until the front and back jaws become solid against each other along their entire lengths. At this point in the cycle the cooling air starts blowing from the air exit apertures 564 and 568 on the seal. The motion of the front 520 and rear 540 slide brackets then reverses and start moving away from each other. The initial movement of the front 520 and rear 540 slide brackets away from each other causes the front 526 and rear 556 jaw assemblies to begin moving away from each other and away from the seal formed in the film. When the jaw assemblies 526 are a quarter to a half inch apart there is a pause in their movement. This pause provides sufficient time for the seal to chill. When enough time has elapsed for the seal to sufficiently chill such that the seal can support the weight of the product movement of the jaw assemblies 526 and 556 resume in the direction away from each other. When the jaws are about an inch and a half apart the grippers have reached the end of their relative travel and begin opening along with the jaw assemblies 526 and 556. The cooling air is continues at this point in the cycle and The jaw assemblies 526, 556 and the grippers then move to their full open position.

Figure 5:
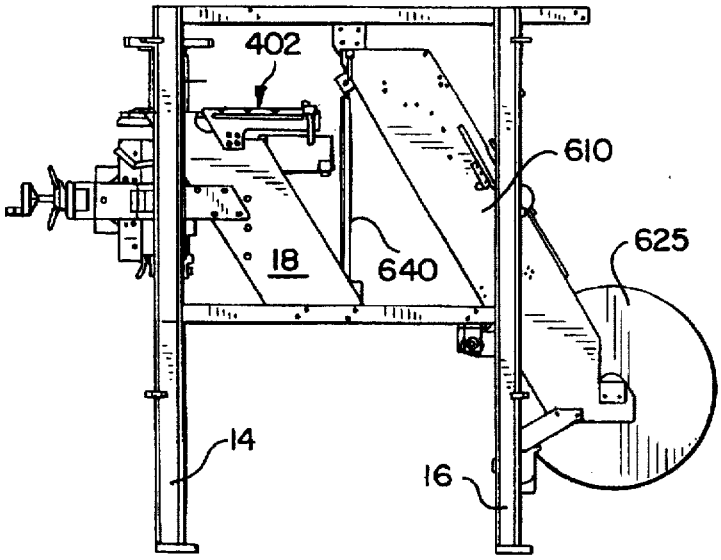
FIG. 5 is a right side view of the form-fill-seal machine.
Figure 24:
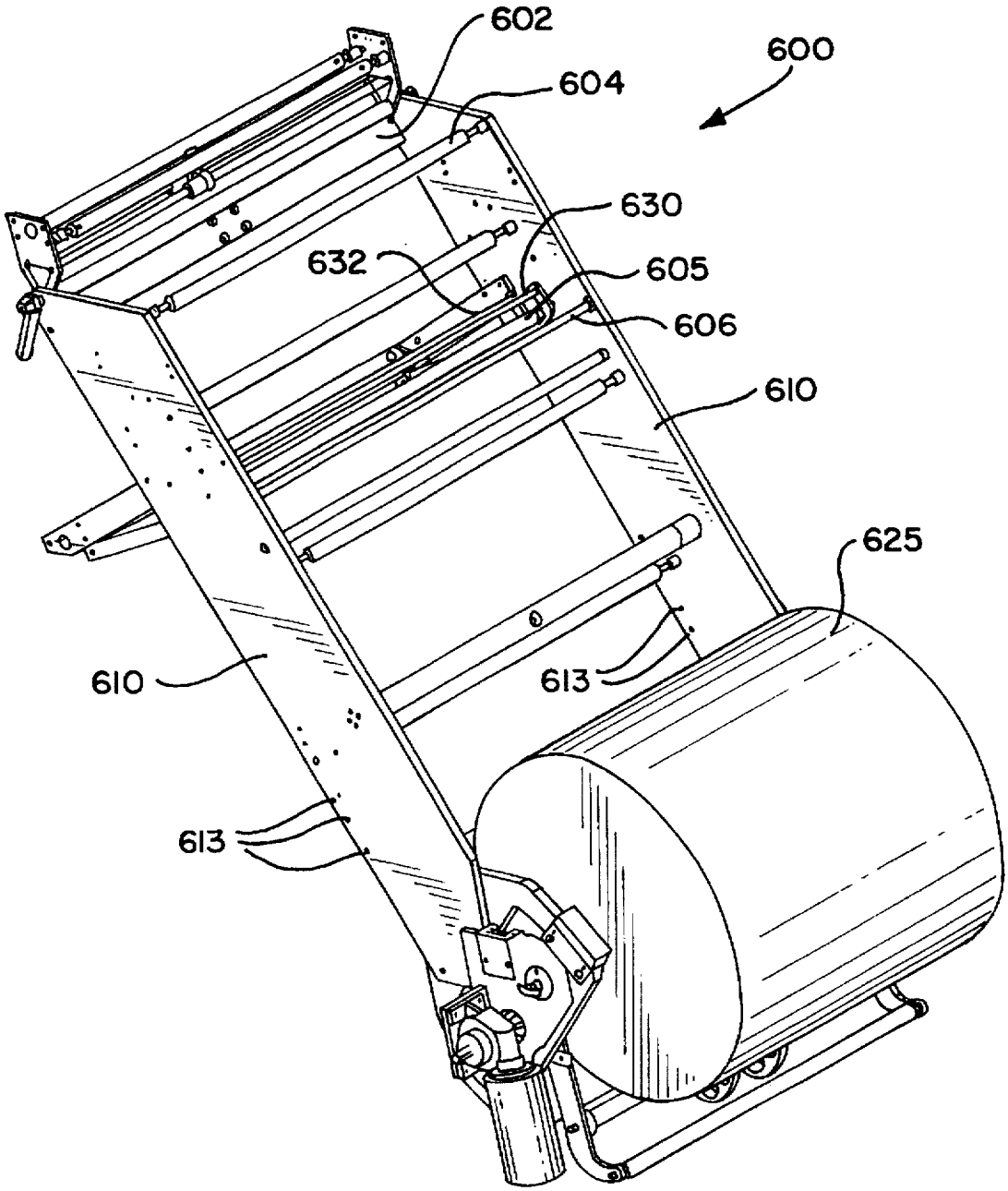
FIG. 24 is an isolated perspective view of the film cage assembly.

The film cage 600, see FIG. 24, includes a pair of side plates 610 that are maintained in relative parallel relationship by a cylinder bar mounting 602, rollers 604,605 and 606. The film cage 600 is pivotally mounted on the rear support member 11 of the form-fill-seal machine 10. The pivotal connection between the frame 11 of the form-fill-seal machine 10 and the film cage 600 can be seen in FIGS. 1, 4 and 5 and in FIG. 22 which is an exploded view of the mounting mechanism and the film tracking assembly.

Figures 22, 23:
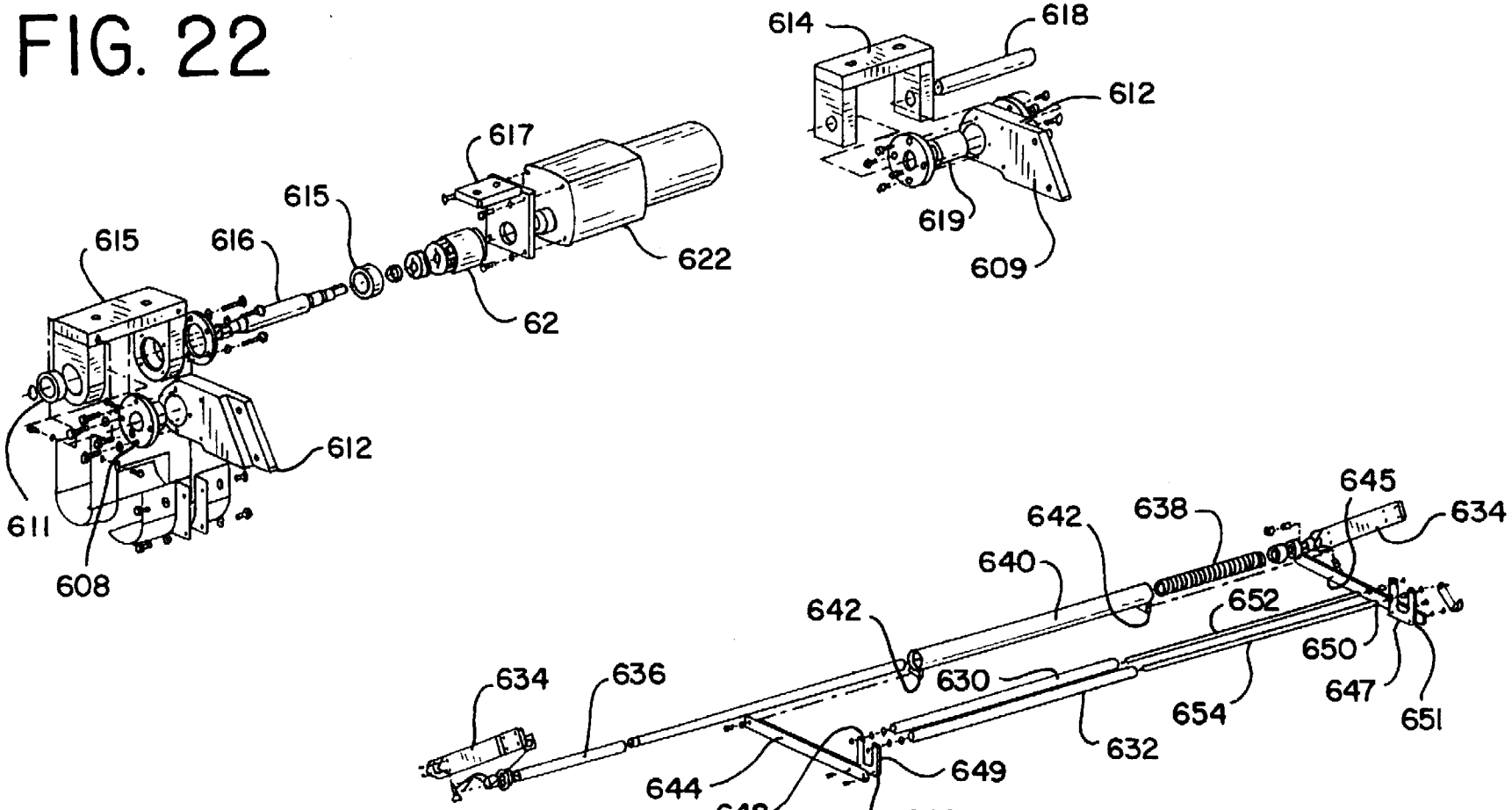
FIG. 22 is an exploded perspective view of the film tracking assembly.
FIG. 23 is an exploded perspective view of the dancer bar assembly.

As is best seen in FIG. 22, a right 609 and a left 612 film cage support are secured, for example by nuts and bolts to apertures 613 formed in the lower front edges of side plates 610 (see FIG. 24). The right film cage support 609 has a bore at its forward end that carries a bearing 619. The left film cage support 612 has an internally threaded adjustment nut 608 secured in a bore at its forward end. Film cage adjusting brackets 614 and 615 and the motor mounting bracket 617 are, as best seen in FIGS. 1, secured to the rear support member 11 of the form-fill-seal machine 10. The right film cage adjusting bracket 614 includes downwardly extending spaced flanges that have aligned apertures that receive an idler shaft 618 upon which the bearing 619 can slide axially. The left film cage adjusting bracket 615 includes downwardly extending spaced flanges that have aligned apertures that receive an externally threaded drive shaft 616 that meshes with the internally threaded adjustment nut 608. Externally threaded drive shaft 616 is driven through a flexible coupling 620 and gears by a motor 622 that is carried by the motor mounting bracket 617. When motor 622 is actuated it causes rotation of externally threaded drive shaft 616 which causes the internally threaded adjustment nut 608 to move axially along the externally threaded drive shaft 616. The axial movement of adjustment nut 608 carries the entire film cage 600 with it. It should be noted that the range of axial movement of the film cage is limited by the space between the downwardly extending spaced flanges on the brackets 614 and 615. The externally threaded drive shaft 616 is driven through a flexible coupling 620 and gear box by the motor 622. Upon actuation of motor 622 the film cage 600 is moved to the right or left adjust or correct the tracking of the film. A very important advantage of the subject invention is that as a result of the film tracking and pivoting of the film cage being performed on the same axis, the film cage 600 can be pivoted between the operative and loading positions without disrupting the adjustment of the film tracking. As a result of both systems being on the same axis, either can be adjusted without placing stress on or changing the adjustment of the other. As a result when a film roll is used up, the operation of the machine is stopped and the film cage 600 is pivoted to the vertical loading position. At this vertical position the spent roll is removed and a new role 625 is rolled up to the rear of the machine. With the film cage 600 in the vertical loading position the film roll mounts 624 have been lowered to a height where a new film roll 625 can be rolled onto the mounts 624 without lifting the role. The film from the new film role must then be threaded through the plurality of rollers of the film cage. This procedure has been simplified as a result of the film cage now being in the vertical position since the film cage and the rollers are closer to the operator who is behind the machine. In prior art machines the film cage and associated rollers are inclined toward the center of the machine and the person threading the film through the rollers must reach into the center of the machine to reach the rollers. Furthermore, with the film cage 600 in the vertical loading position, the person threading the film can grasp a dancer arm 644 or 645 and pivot it to the horizontal position at which position the dancer rolls 630 and 632 are much closer to the person and there is an open horizontal slot between the dancer rolls 630, 632 and the roll 605 that they interact with through which the film can be threaded. After the film from the new film role 625 has been threaded and spliced to the end of the old film the film, cage 600 can be pivoted to the operative inclined position. The adjustment of the film tracking has not been changed or disturbed in any way and the machine can be restarted without making time consuming adjustments.

Figure 25:
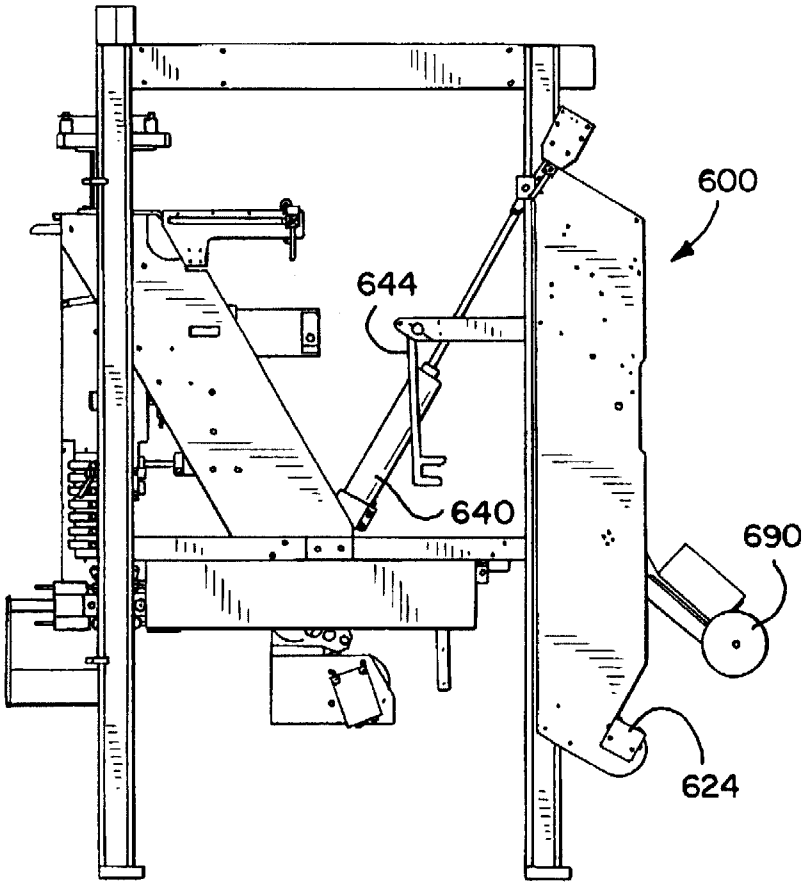
FIG. 25 is a schematic side view of the machine with the film cage in the vertical loading position, when the film is not loaded.

The rod end of a pneumatic air cylinder 640, see FIG. 25, is pivotally connected to the cylinder bar mounting 602 at the top front of the film cage 600. The head end of cylinder 640 is secured to the mid support member 9 of the machine 10. Actuation of cylinder 640 pivots the film cage 600 about shafts 616 and 618 from the inclined operative position to the vertical film roll loading position.

The film roll loading position of the film cage 600 provides the advantage that the position of the film roll mounts 624 have pivoted down about the axes of shafts 616 and 618 to a lower level. At this lower level of the film roll mounts 624 it is possible to mount new film rolls 625 on the mounts 624 without the need of an overhead hoist or other such power equipment. Thus, when it is necessary to load a new film roll 625 on the machine 10, the machine operator can without additional help or special power equipment simply roll the new film roll 625 onto the film roll mounts 624.

Another advantage that is gained by moving the film cage 600 to its vertical film roll loading position is that it greatly facilitates the threading of the film through the series of rollers that controls the film. As a result of tilting the film cage to its vertical position the rolls are much closer to a person located at the rear of the machine 10 and, thus, it is not necessary for the person loading the film to reach into the center of the machine to thread the film around the rollers. A particular difficult set of roller to load the film around are those known as the dancer rollers 630 and 632. The dancer rollers 630, 632 are not fixed relative to the film cage side plates 610 but rather are carried at the ends of dancer arms 644 and 645 that are pivotally mounted to allow them to float.

The dancer rollers 630 and 632 and their mounting mechanism are best seen in FIG. 24 and exploded view FIG. 23. Arms 634 are secured to side plates 610 and extend from the front edges of the side plates 610 toward the front of the machine 10. Arms 634 are rigidly connected to the side plates and terminate in free ends. The free ends of arms 634 are connected by a torsion tube assembly that includes a rod 636 that is secured at its ends to the arms 634. Rod 636 extend down the center of an elongated coil spring 638. A torque tube 640 receives the coil spring 638 and rod 636. One end of coil spring 638 is secured to rod 636 and the other end is anchored in the torque tube 640. This functions as a counterbalance to the torque tube 640 which is transferred to the dancer rollers 630 and 632. By changing coil spring 638 the tension exerted on the film can be changed to better accommodate a particular use of the machine. The torque tube 640 has a mounting tab 642 at each end to which are rigidly secured dancer arms 644 and 645. At the free ends of dancer arms 644 and 645 are secured U-shaped brackets 646 and 647 respectively. U-shaped bracket 646 has free ends 648 and 649 and U-shaped bracket 647 has free ends 650 and 651. Free ends 648 and 650 are connected by a rod 652 upon which is mounted the dancer roller tube 630. Free ends 649 and 651 are connected by a rod 654 upon which is mounted the dancer roller tube 632. The torque exerted by spring 638 provides a counterbalancing force to the dancer roller tubes 630 and 632 which effects the tension that these rolls apply to the film. The spring 638 can be replaced by one of different tension if it is desired to change the tension being applied to the film. However, the torque provided by spring 638 is not sufficient to hold the dancer arms 644 and 645 and the dancer rolls 630 and 632 up when the rolls are not in engagement with the film. Thus, the film holds the dancer up when the film is not threaded through the dancer rolls 630 and 632. When film is not threaded through the dancer mechanism, the dancer arms 644 and 645 along with the dancer rolls 630 and 632 hang vertical down like a pendulum. When the operation of the machine is stopped the weight of the dancer arms 644 and 645 along with the dancer rolls 630 and 632 cause them to move downwardly. Since the movement of the dancer is effected by its weight, which is constant, the location of the dancer does not effect the tension exerted on the film by the dancer. The main function of the dancer rolls is to speeds up or slows down the power unwind of the film from the film roll 625. When the dancer gets high the power unwind speeds up and when the dancer gets low the power unwind slows down. When the operation of the machine is stopped the dancer goes low because you are no longer using film. This slows down the power unwind as the dancer drops until it finally it is in its lowest most position. The tension on the film is not effected or changed as a result of the position of the dancer.

When operation of the machine is initiated, the dancer rolls are at their lowest position. An operator who is threading the film from the film roll 625 through the series of rollers, grasps a dancer arm 644 or 645 and raises the dancer rollers 630 and 632 up toward the position that they are in during operation. As a result of the film cage 600 being in its vertical position there is a straight path between the dancer rollers 630, 632 and the cooperating roller 605 and 606 through which the film can be conveniently threaded. After the film is threaded between the dancer rollers 630, 632 and the cooperating rollers 605 and 606 the operator can release the dancer arm 644 or 645 and the dancer rollers 630, 632 will gravitate downwardly. The power unwind of the large film roll 625 starts from zero and increases to its selected speed. The machine is consuming film during this start up when the film roll 625 is accelerating to its operating speed. During this start up period the dancers pivot up which release the film that was accumulated when they moved down to be available for consumption is first several cycles of the machine.

The dancer rollers work in cooperation with rollers 605 and 606 that are fixed relative to the side plates 610, and the film must be threaded between the dancer rollers and the cooperating fixed rollers. This greatly simplifies and speeds up the procedure for loading a new film roll 625 onto the machine and enables the complete operation to be done by one person without the need of special power equipment.

Figure 26:
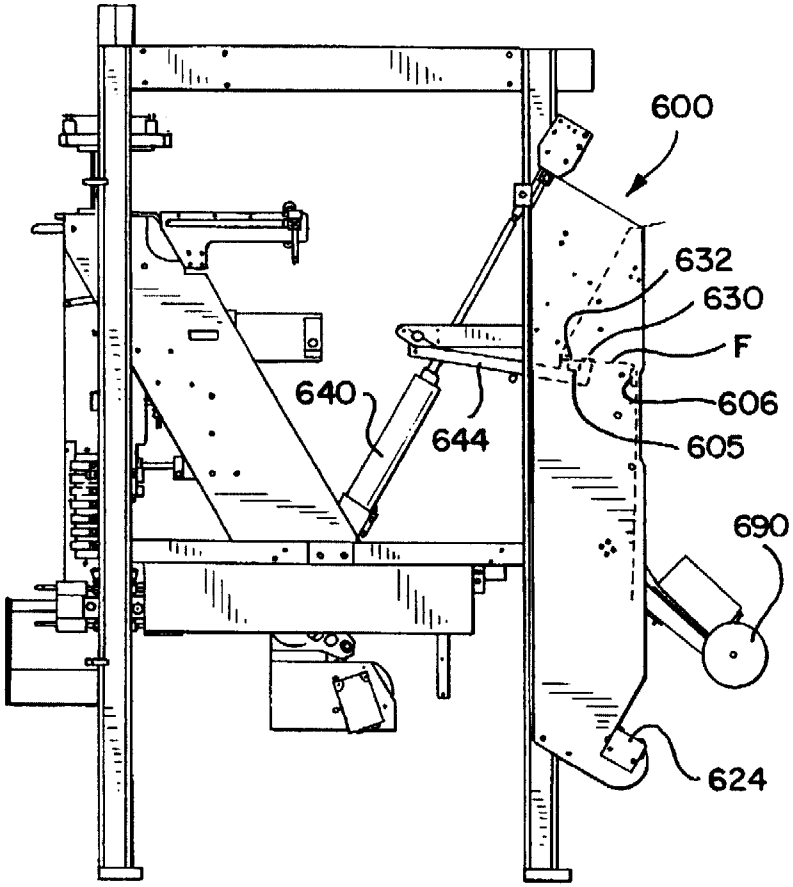
FIG. 26 is a schematic side view of the machine with the film cage in the vertical loading position and the film loaded, as shown by the broken line.

Reference is made to the series of FIGS. 25–28, which illustrate the film cage 600 in its operative position (FIGS. 27 and 28) and its vertical loading position (FIGS. 25 and 26). In FIG. 25, film is not loaded through the series of rolls carried by the film cage 600 and thus the dancer arms 644, 645 are hanging down in a vertical position. In the vertical loading position of the film cage seen in FIG. 25 the film roll mounts 624 for the film roll 625 are at there lowered position. At this lowered position a new roll can be rolled up to and easily placed on the film roll mounts 624. The loading of the film roll 625 can be accomplished by hand by a single operator and the need for power equipment such as an overhead crane is not required. Also, with the film cage in the position illustrated in FIG. 25, an operator standing directly behind the film cage 600 is within reach of the rollers 604,605,606 carried by the film cage over which the film is strung.

In FIG. 26, the series of rolls carried by the film cage 600 are represented by broken line circles and the film is represented by a broken line F. When the operator is threading the film from a new film roll 625 through the series or rolls a dancer arm 644 or 645 is grasped by the operator and pivoted up toward the operator to a horizontal position. In this horizontal position the dancer rollers 630 and 632 are aligned in a horizontal plane that is spaced above the horizontal plane of film cage rollers 605 and 606. There is a horizontal opening between the horizontal plane of the dancer rollers 630, 632 and the horizontal plane of firm cage rollers 605, 606 through which the film can be inserted in the film threading process. This simplifies the film threading process considerably since not only are the film cage rollers located at an easy reach to the operator the film can be properly threaded around rollers 630, 632, 605 and 606 by merely passing it through a horizontal opening between two sets of rollers.

Figure 27:
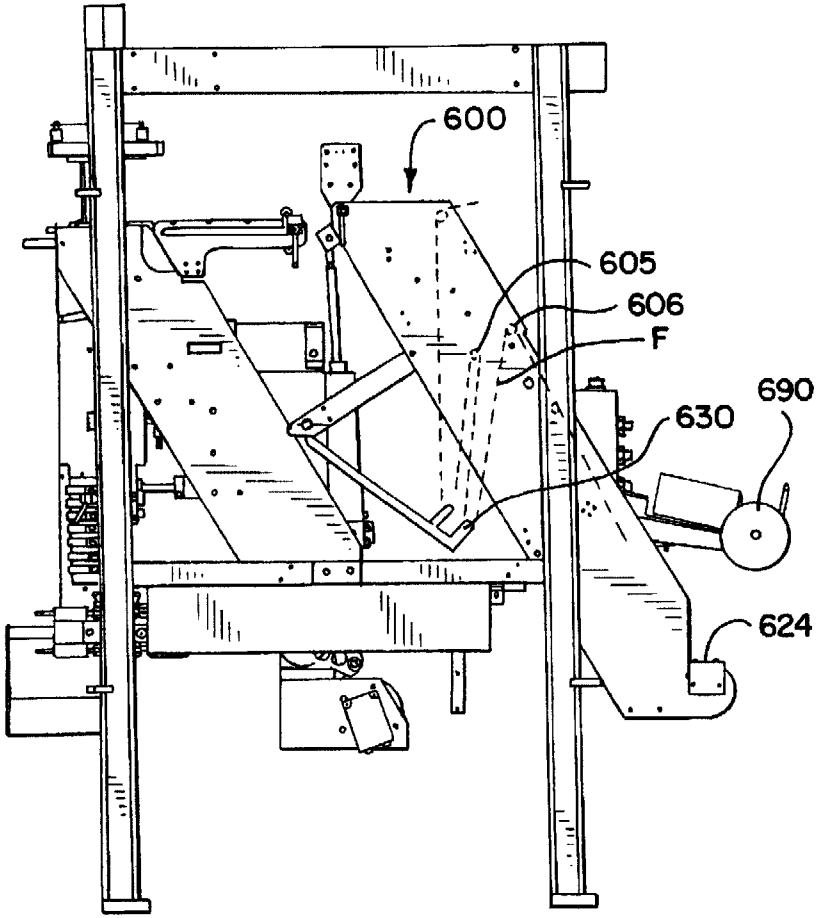
FIG. 27 is a schematic side view of the machine with the film cage in its inclined operative position and the dancer arms shown moved toward the vertical position.

In FIG. 27, the film cage 600 has been pivoted to its inclined processing position and the operator has released the dancer arms 644 and 645 which have moved by gravity toward a vertical position. In this position of the film cage 600 and dancer arms 644 and 645 the film follows a festoon like pattern between the rollers 630, 632, 680 and 682. A considerable length of film is consumed by the flights extending between the rollers.

Figure 28:
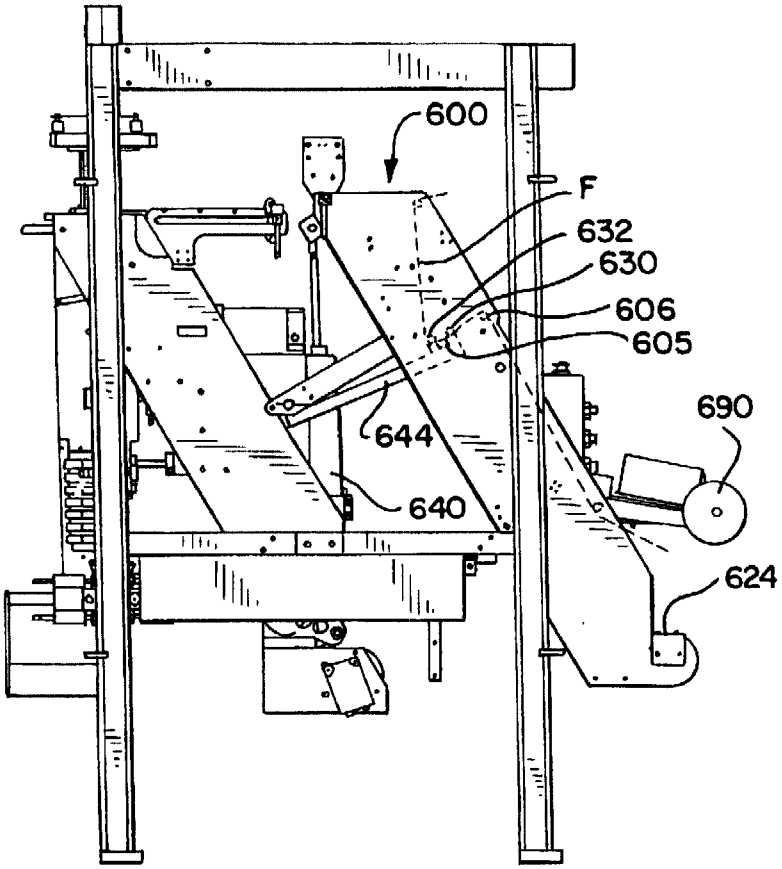
FIG. 28 is a schematic side view of the machine with the film cage in its inclined operative position and the dancer arms shown in their normal operative position.

When the operation of the machine is began the power feed 690 for the film roll 625 is turned on however the relatively large film roll 625 requires time to accelerate to its operating speed. During this start up period the bag forming components of the machine reach operating speed almost instantaneously. The lengths of film that were created as a result of the dancer arms 644 and 645 hanging down toward the vertical position is used during the start up period. When these lengths of material have been exhausted, the power feed 690 for the film roll 625 has reached its operating speed and sufficient film is being dispensed from the roll to accommodate the bag forming operation. The elimination of these stored film lengths causes the dancer arms 644 and 645 to pivot up such that the dancer rolls 630, 632 move to a position above the roller 605. This position of the dancer arms 644 and 645 and the dancer rolls 630 and 632 is illustrated in FIG. 28. FIG. 28 illustrates the position of the dancer arms 644, 645 during normal operation of the machine.

When the machine is turned off, the power to the power feed 690 for the film roll 625 is not turned off and continues to respond to the position of the dancer. However, now film is not being consumed at the other end of the film sheet and the dancer moves to its lower most position and functions to maintain tension on the film. The sensor on the dancer functions to reduce the voltage supplied to the power feed direct current motor as the dancer moves lower. Thus, the voltage supplied to the motor continues to decrease while maintaining tension on the film and eventually there is insufficient voltage to drive the motor. When the machine is started and consumption of the film is resumed, the dancer begins to move up, thus increasing the voltage to the motor, and feeding of the film is resumed.

While the invention has heretofore been described in detail with particular reference to illustrated apparatus,it is to be understood that variations, modifications and the use of equivalent mechanisms can be effected without departing from the scope of this invention. It is, therefore, intended that such changes and modifications be covered by the following claims.

What is claimed is:

1. A machine for forming, filling and sealing packages of different sizes and shapes comprising:

a machine frame that is adapted to support a change part in a predetermined fixed position thereon;

a change part that can be supported on said machine frame at a lock position;

a lock mechanism for locking said change part at said lock position on said machine frame;

a pair of drive belt assemblies mounted on said machine frame such that they are biased into engagement with said change part and their position relative to said change part is established by this engagement;

a film cage mounted on said machine frame about a horizontal axis, said film cage being pivotable about said horizontal axis between an inclined operating position, at which its upper portion is located toward the central region of the machine and its bottom portion extends rearward of the back of the machine, and a vertical loading position, said film cage also being movable horizontally along said horizontal pivot axis for the purpose of film tracking;

pivoting of the film cage about the horizontal axis and movement of the film cage horizontally along said horizontal axis being independent of and unaffected by each other.

2. The invention as set forth in claim 1 wherein the position of said drive belts that is established by their engagement with said change part provides for a space between the top of said drive belt assemblies and said change part.

3. The invention as set forth in claim 1 wherein each drive belt assembly includes an upper drive and lower driven pulleys that have continuous belts extending thereover that function to pull the film from which the packages are formed down the change part.

4. The invention as set forth in claim 2 wherein said space between the top of said drive belt assemblies and said change part is approximately 0.02 inches.

5. The invention as set forth in claim 3 wherein said continuous belts have slots formed therein and there is a vacuum source on the under surfaces of the continuous belt runs that are adjacent said forming tube such that the film from which the package is being formed is held by vacuum against the surface of said continuous belts frictional contact with said change part is avoided.

6. The invention as set forth in claim 1 wherein the position of said drive belts that is established by their engagement with said change part provides for the bottom of said drive belt assemblies to be in contact with said change part.

7. The invention as set forth in claim 2 wherein the position of said drive belts that is established by their engagement with said change part provides for the bottom of said drive belt assemblies to be in contact with said change part.

8. The invention as set forth in claim 7 wherein said space between the top of said drive belt assemblies and said change part is approximately 0.02 inches.

9. The invention as set forth in claim 1, wherein said film cage extends downward below said horizontal axis, film roll mounts carried by said film cage at a level below said horizontal axis such that a film roll can be mounted on said film roll mounts with out lifting the film roll.

10. The invention as set forth in claim 1 wherein the invention further includes an electric motor mounted on film cage horizontal axis, such that when said electric motor is actuated to drive in one direction the film cage is moved laterally of the machine, in one direction, along said horizontal pivot axis and when said electric motor is driven in the opposite direction the film cage is moved laterally of the machine, along said horizontal pivot axis in the other direction.

11. A machine for forming, filling and sealing packages of different sizes and shapes comprising:

a selection of change parts, a machine frame including precision support surfaces that are adapted to support a change part in a predetermined fixed position thereon;

each change part, of said selection of change parts, having uniform surfaces that complement said precision support surfaces of said machine frame, such that said uniform surfaces of said change part can engage said precision support surfaces of said machine frame at a lock position;

a lock mechanism for locking said change part at the lock position on said machine frame;

each change part, of said selection of change parts, including a forming shoulder and a vertically extending forming tube, said forming shoulder and forming tube being shaped and sized to form a uniquely shaped and sized package;

said forming shoulder including reference surfaces that have a fixed ratio to the diameter of said forming tube;

a pair of drive belt assemblies mounted on said machine frame such that said vertically extending forming tube is located between the drive belt assemblies;

each drive belt assembly including a mounting member that is pivotally mounted on said machine frame and an elongated support that is pivotally carried by said mounting member, said elongated supports having an upper drive pulley and a lower driven pulley mounted thereon;

each of said elongated supports including a stop that is adjacent to a reference surface on said forming tube;

a biasing device connected to both of said mounting members and causing said mounting members to pivot in opposite directions about their pivotal mounts on said machine frame such that said stops engage said reference surfaces on said forming shoulder.

12. The invention as set forth in claim 11 wherein when said stops engage the ends of said elongated supports that are opposite to the ends that include the stop continue to move toward said forming tube until said lower driven pulleys contact said forming tube and further movement of the elongated supports is stopped.

13. The invention as set forth in claim 11 wherein a continuous belts extends over each set of upper drive and lower driven pulleys that function to pull the film from which the packages are formed down the forming tube.

14. The invention as set forth in claim 11 wherein said upper drive pulley and the pivot support of said elongated support on said mounting member are on a common axis.

15. The invention as set forth in claim 12 wherein when said stops are engaged and said lower driven pulleys are in contact with said forming tube said upper drive pulleys are spaced from said forming tube.

16. The invention as set forth in claim 15 wherein the space between said upper drive pulleys and said forming tube is approximately 0.02 inches.

17. The invention as set forth in claims 13 wherein said continuous belts have slots formed therein and there is a vacuum source on the under surfaces of the continuous belt runs that are adjacent said forming tube such that the film from which the package is being formed is held by vacuum against the surface of said continuous belts and avoids frictional contact with said forming tube except for the line contact where the lower driven pulley contacts the forming tube.

18. The invention as set forth in claim 13 wherein when said stops engage the ends of said elongated supports that are opposite to the ends that include the stop continue to move toward said forming tube until said lower driven pulleys contact said forming tube and further movement of the elongated supports is stopped.

19. The invention as set forth in claim 18 wherein when said stops are engaged and said lower driven pulleys are in contact with said forming tube said upper drive pulleys are spaced from said forming tube.

20. The invention as set forth in claim 19 wherein the space between said upper drive pulleys and said forming tube is approximately 0.02 inches.

21. The invention as set forth in claim 14 wherein when said stops engage the ends of said elongated supports that are opposite to the ends that include the stop continue to move toward said forming tube until said lower driven pulleys contact said forming tube and further movement of the elongated supports is stopped.

22. The invention as set forth in claim 21 wherein when said stops are engaged and said lower driven pulleys are in contact with said forming tube said upper drive pulleys are spaced from said forming tube.

23. The invention as set forth in claim 22 wherein the space between said upper drive pulleys and said forming tube is approximately 0.02 inches.

24. A method of mounting a change part on a form, fill and seal machine such that the pull belt assemblies are aligned and require no further adjustment comprising the steps of:

a. selecting a change part, that includes a forming tube, that meets the size and shape requirements of a desired package;

b. placing the selected change part on the form fill and seal machine such that complementary machined surfaces on the change part and on the machine are adjacent;

c. locking said change part on the machine with the complementary machined surfaces engaged;

d. moving the pull belt assemblies toward each other and toward opposite sides of the forming tube;

e. engaging stop surfaces on the change part with stops on the upper portion of the pull belt assemblies;

f. continuing to move the pull belt assemblies toward each other and toward opposite sides of the forming tube after the stops on the upper portions of the pull belt assemblies engage the stop surfaces on the change part until the lower portion of the pull belt assemblies make line contact with the forming tube.

25. The method as set forth in claim 24 wherein the following additional step is performed:

g. maintaining a gap between the upper portion of the pull belt assemblies and the forming tube to minimize friction between the film and the forming tube.

26. The method as set forth in claim 24 wherein the following additional step is performed:

g. maintaining a gap of about 0.02 inches between the upper portion of the pull belt assemblies and the forming tube to minimize friction between the film and the forming tube.

27. A machine for forming, filling and sealing packages of different sizes and shapes comprising:

a machine frame that is adapted to support a change part in a predetermined fixed position thereon;

a change part that can be supported on said machine frame at a lock position;

lock mechanism for locking said change part at the lock position on said machine frame;

said change part including a forming shoulder, a vertically extending forming tube and reference surfaces that have a fixed ratio to the diameter of said forming tube;

a pair of drive belt assemblies mounted on said machine frame such that said vertically extending forming tube is located between the drive belt assemblies;

each drive belt assembly including a pivotally mounted elongated support having an upper drive pulley and a lower driven pulley mounted thereon;

each of said elongated supports including a stop that is adjacent to a reference surface on said forming tube;

a biasing device connecting said drive belt assemblies and causing said elongated support to pivot in opposite directions such that said stops engage said reference surfaces on said forming shoulder.

28. The invention as set forth in claim 27 wherein when said stops engage the ends of said elongated supports that are opposite to the ends that include the stop continue to move toward said forming tube until said lower driven pulleys contact said forming tube and further movement of the elongated supports is stopped.

29. The invention as set forth in claim 27 wherein a continuous belts extends over each set of upper drive and lower driven pulleys that function to pull the film from which the packages are formed down the forming tube.

30. The invention as set forth in claim 27 wherein said upper drive pulley and the pivot support of said elongated support are on a common axis.

31. The invention as set forth in claim 28 wherein when said stops are engaged and said lower driven pulleys are in contact with said forming tube said upper drive pulleys are spaced from said forming tube.

32. The invention as set forth in claim 28 wherein the space between said upper drive pulleys and said forming tube is approximately 0.02 inches.

33. The invention as set forth in claims 29 wherein said continuous belts have slots formed therein and there is a vacuum source on the under surfaces of the continuous belt runs that are adjacent said forming tube such that the film from which the package is being formed is held by vacuum against the surface of said continuous belts and avoids frictional contact with said forming tube except for the line contact where the lower driven pulley contacts the forming tube.

34. The invention as set forth in claim 29 wherein when said stops engage the ends of said elongated supports that are opposite to the ends that include the stop continue to move toward said forming tube until said lower driven pulleys contact said forming tube and further movement of the elongated supports is stopped.

35. The invention as set forth in claim 34 wherein when said stops are engaged and said lower driven pulleys are in contact with said forming tube said upper drive pulleys are spaced from said forming tube.

36. The invention as set forth in claim 35 wherein the space between said upper drive pulleys and said forming tube is approximately 0.02 inches.

37. The invention as set forth in claim 30 wherein when said stops engage the ends of said elongated supports that are opposite to the ends that include the stop continue to move toward said forming tube until said lower driven pulleys contact said forming tube and further movement of the elongated supports is stopped.

38. The invention as set forth in claim 37 wherein when said stops are engaged and said lower driven pulleys are in contact with said forming tube when said upper drive pulleys are spaced from said forming tube.

39. The invention as set forth in claim 37 wherein the space between said upper drive pulleys and said forming tube is approximately 0.02 inches.

40. A method of mounting a change part on a form, fill and seal machine such that the pull belt assemblies are aligned and require no further adjustment comprising the steps of:

a. placing the selected change part on the form fill and seal machine such that complementary machined surfaces on the change part and on the machine are adjacent;

b. locking said change part on the machine with the complementary machined surfaces engaged;

c. moving the pull belt assemblies toward each other and toward opposite sides of the forming tube;

d. engaging stop surfaces on the change part with stops on the upper portion of the pull belt assemblies;

e. continuing to move the pull belt assemblies toward each other and toward opposite sides of the forming tube after the stops on the upper portions of the pull belt assemblies engage the stop surfaces on the change part until the lower portion of the pull belt assemblies make line contact with the forming tube.

41. The method as set forth in claim 40 wherein the following additional step is performed:

f. maintaining a gap between the upper portion of the pull belt assemblies and the forming tube to minimize friction between the film and the forming tube.

42. The method as set forth in claim 40 wherein the following additional step is performed:

f. maintaining a gap of about 0.02 inches between the upper portion of the pull belt assemblies and the forming tube to minimize friction between the film and the forming tube.

43. A form, fill and seal machine for making packages of predetermined size and shape from a continuous sheet of film comprising:

a continuous sheet of film in the form of a film roll supported on the machine during operation such that it can be replaced when exhausted or when a film of a different type is to be used, said film roll when full having a predetermined diameter;

a machine frame including a plurality of vertical columns that are interconnected by a plurality of horizontal support members, said vertical columns including bases that are adapted to rest on the machine support surface, one of said horizontal support members, the rear support member, extending across the lower back of the machine, above the machine support surface a distance approximately equal to said predetermined diameter;

a film cage, upon which said film roll is carried, mounted on said rear support member about a horizontal pivot axis, said film cage being pivotable about and movable horizontally along said horizontal pivot axis, said film cage being pivotable between an inclined operating position, at which its upper portion is located toward the central region of the machine and its bottom portion extends rearward of the back of the machine, and a vertical loading position, said film cage extending downward below said pivot axis at least a distance equal to half of said predetermined diameter, film roll mounts carried by said film cage at a level below said horizontal pivot axis and at a distance of approximately half of said predetermined diameter when said film cage is in the vertical loading position such that said film roll can be mounted on said film roll mounts with out lifting the film roll;

said film cage being movable horizontally along said horizontal pivot axis for the purpose of tracking the film dispersed from the film roll to align it with the package forming components of the machine.

44. The invention as set forth in claim 43 wherein the invention further includes an electric motor mounted on said rear support member that drives a threaded shaft that has threaded there on an adjustment nut that is fixed to said film cage such that when said electric motor is actuated to drive in one direction the film cage is moved laterally of the machine, in one direction, along said horizontal pivot axis and when said electric motor is driven in the opposite direction the film cage is moved laterally of the machine, along said horizontal pivot axis in the other direction.

45. The invention as set forth in claim 43 wherein the invention further includes a plurality of rollers carried by and fixed relative to the film cage, a torque tube pivotally mounted on said film cage, a pair of dancer arms secured to and extending from opposite ends of said torque tube, a pair of spaced apart parallel dancer rolls carried by the free ends of said dancer arms such that said dancer arms and dancer rolls extend from said torque tube as a pendulum and exert a downward force on the film that is threaded through said dancer rolls and said rollers carried by and fixed relative to the film cage, said torque tube being spring biased to exert an additional downward force on said film.

46. The invention as set forth in claim 45 wherein the invention further comprises:

the magnitude of the torque in said torque tube can be change by replacing the spring that produces the torque with a spring of different strength.

47. The invention as set forth in claim 44 wherein the invention further comprises: said pair of dancer rolls becoming located relative to one of said plurality of rollers carried by and fixed relative to said film cage such that there is an open horizontal slot through which the film can be threaded when the film cage is in the vertical position and the dancer arms have been manually raised to the horizontal position which greatly facilitates the ease of threading the film through the dancer rolls and plurality of rollers carried by and fixed relative to said film cage.

* * * * *

UNITED STATES PATENT AND TRADEMARK OFFICE

CERTIFICATE OF CORRECTION

PATENT NO. : 5,715,656
DATED : February 10, 1998
INVENTOR(S) : Larry N. Pearce

It is certified that error appears in the above-identified patent and that said Letters Patent is hereby corrected as shown below:

On the Title Page, Item [56]

In column 2, line 11, change "5,576,588 11/1996" to --4,576,588 03/1986--.

In column 2, line 4, under "ABSTRACT", change "provide" to --provided--.

In claim 13, line 2, change "belts" to --belt--.

In claim 17, line 1, change "claims" to --claim--.

In claim 29, line 2, change "belts" to --belt--.

In claim 33, line 1, change "claims" to --claim--.

In claim 46, line 4, change "change" to --changed--.

Signed and Sealed this

Ninth Day of May, 2000

*Attest:*

Q. TODD DICKINSON

*Attesting Officer*

*Director of Patents and Trademarks*